US008741526B2

(12) United States Patent
Teshima et al.

(10) Patent No.: US 8,741,526 B2
(45) Date of Patent: Jun. 3, 2014

(54) DEVELOPER

(75) Inventors: Takashi Teshima, Nara (JP); Junichi Ishikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 79 days.

(21) Appl. No.: 13/456,836

(22) Filed: Apr. 26, 2012

(65) Prior Publication Data

US 2012/0288792 A1 Nov. 15, 2012

(30) Foreign Application Priority Data

May 9, 2011 (JP) ..... 2011-104644
May 9, 2011 (JP) ..... 2011-104645
May 9, 2011 (JP) ..... 2011-104646

(51) Int. Cl.
*G03G 9/08* (2006.01)

(52) U.S. Cl.
USPC ..... 430/115

(58) Field of Classification Search
USPC ..... 430/115
See application file for complete search history.

(56) References Cited

U.S. PATENT DOCUMENTS 4,879,197 A 11/1989 Kohmura et al.
5,783,350 A 7/1998 Matsuoka et al.
2008/0124645 A1* 5/2008 Yamanaka et al. ..... 430/115

FOREIGN PATENT DOCUMENTS

JP 62-066270 A 3/1987
JP 09-160309 A 6/1997
JP 2007-219380 A 8/2007

* cited by examiner

*Primary Examiner* — Mark A Chapman
(74) *Attorney, Agent, or Firm* — Global IP Counselors, LLP

(57) ABSTRACT

There is provided a developer that has excellent positive charging characteristics and charging stability, and which is compatible with high-speed developing. The developer of the invention contains toner particles and an insulating liquid, wherein a fatty acid ester is contained as the insulating liquid, a substance A expressed by the following formula (1) and/or a substance B expressed by the following formula (2) is further contained, and the total percentage in which substance A and substance B are contained is at least 0.1 wt % and no more than 3.0 wt %.

(1)

(2)

12 Claims, 2 Drawing Sheets

DEVELOPER

CROSS-REFERENCE INVENTION TO RELATED APPLICATIONS

This application claims priority to Japanese Patent Application No. 2011-104644 filed on May 9, 2011, Japanese Patent Application No. 2011-104645 filed on May 9, 2011, and Japanese Patent Application No. 2011-104646 filed on May 9, 2011. The entire disclosure of Japanese Patent Application Nos. 2011-104644, 2011-104645 and 2011-104646 is hereby incorporated herein by reference.

BACKGROUND

1. Technical Field

The present invention relates to a developer.

2. Background Technology

A developer in which a toner made up of a material containing a pigment or other such colorant and a binder resin is dispersed in an electrically insulating carrier liquid (insulating liquid) is known as a developer used to develop electrostatic latent images formed on a latent image carrier.

Resin materials such as epoxy resins, polyester resins, and styrene-acrylic ester copolymers have been used for the toner particles that make up such developers (see Patent Literature 1, for example). These resin materials are easy to handle, the resulting images have good color expression, and good fixing characteristics are obtained.

Nevertheless, the resin materials used as the constituent material of toner particles generally have a negative charge themselves, so it is difficult to apply them to toner particles (a developer) with a positive charge. It is also possible to add a charge control agent to toner particles containing such a resin material to make the charge positive, but it is difficult to achieve an adequate amount of charge.

Japanese Laid-open Patent Publication No. 2007-219380 (Patent Document 1) is an example of the related art.

SUMMARY

Problems to be Solved by the Invention

It is an advantage of the invention to provide a developer that has excellent positive charging characteristics and charge stability, and which is compatible with high-speed developing.

Means Used to Solve the Above-Mentioned Problems

The stated advantage is achieved by the following present invention.

The developer of the invention contains toner particles and an insulating liquid, wherein a fatty acid ester is contained as the insulating liquid, a substance A expressed by the following formula (1) and/or a substance B expressed by the following formula (2) is further contained, and the total percentage in which substance A and substance B are contained is at least 0.1 wt % and no more than 3.0 wt %.

[First Chemical Formula]

$$R—O—(—AO—)_n—H \quad (1)$$

(In Formula 1, R is a phenyl group, a styrylated phenyl group, an α-naphthyl group, or a β-naphthyl group, A is an alkylene group, and n is an integer of at least 1.)

[Second Chemical Formula]

$$(RO)_n—\overset{\overset{\displaystyle O}{\|}}{P}—(OH)_{3-n} \quad (2)$$

(In Formula 2, R is an organic group having a carbon number of at least 1 and no more than 15, and n is an integer of at least 1 and no more than 3.)

Consequently, a developer can be provided that has excellent positive charging characteristics and charge stability, and which is compatible with high-speed developing.

With the developer of the invention, it is preferable if substance A has a polyoxyethylene structure. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if substance B has a hydrocarbon group with a branched chain. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if substance B has a straight-chain alkyl group with a carbon number of at least 4 and no more than 12. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if substance B is expressed by the following formula (3):

[Third Chemical Formula]

$$(R^1COOR^2O)_n—\overset{\overset{\displaystyle O}{\|}}{P}—(OH)_{3-n} \quad (3)$$

(in Formula 3, $R^1$ is a hydrocarbon group with a carbon number of at least 1 and no more than 7, and $R^2$ is a hydrocarbon group with a carbon number of at least 1 and no more than 7).

Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if $R^1$ has an unsaturated bond. Consequently, the charge stability of the toner particles and their dispersion stability in the insulating liquid will be particularly excellent, and the mobility of the toner particles will be even better, so that high-speed developing can be handled even more favorably.

With the developer of the invention, it is preferable if the relation $0.01 \leq X_A/(X_A+X_B) \leq 0.99$ is satisfied when $X_A$ is the content (wt %) of substance A and $X_B$ is the content (wt %) of substance B. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if the fatty acid ester is an ester of a monovalent fatty acid and a monovalent alcohol. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if the fatty acid ester is an ester of a fatty acid and a straight-chain alcohol. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if the fatty acid ester is an ester of a fatty acid and an alcohol with a carbon number of at least 4 and no more than 14. Consequently, the charge stability of the toner particles and their dispersion stability in the insulating liquid will be particularly excellent, and the mobility of the toner particles will also be particularly excellent, so that high-speed developing can be handled more favorably.

With the developer of the invention, it is preferable if the toner particles are made up of a material containing a polyester resin. Polyester resins have good transparency, and when they are used as a binder resin, the resulting images have good color expression. Also, the toner particles are fixed particularly well to the recording medium. With a well-known developer, it was especially difficult to achieve a positive charge when the toner particles were made up of a polyester resin, but with the invention, even if the toner particles are made up of a polyester resin, the positive charging characteristics and charge stability will be completely satisfactory. Specifically, the effect of the invention will be particularly pronounced when the toner particles are made up of a material containing a polyester resin.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
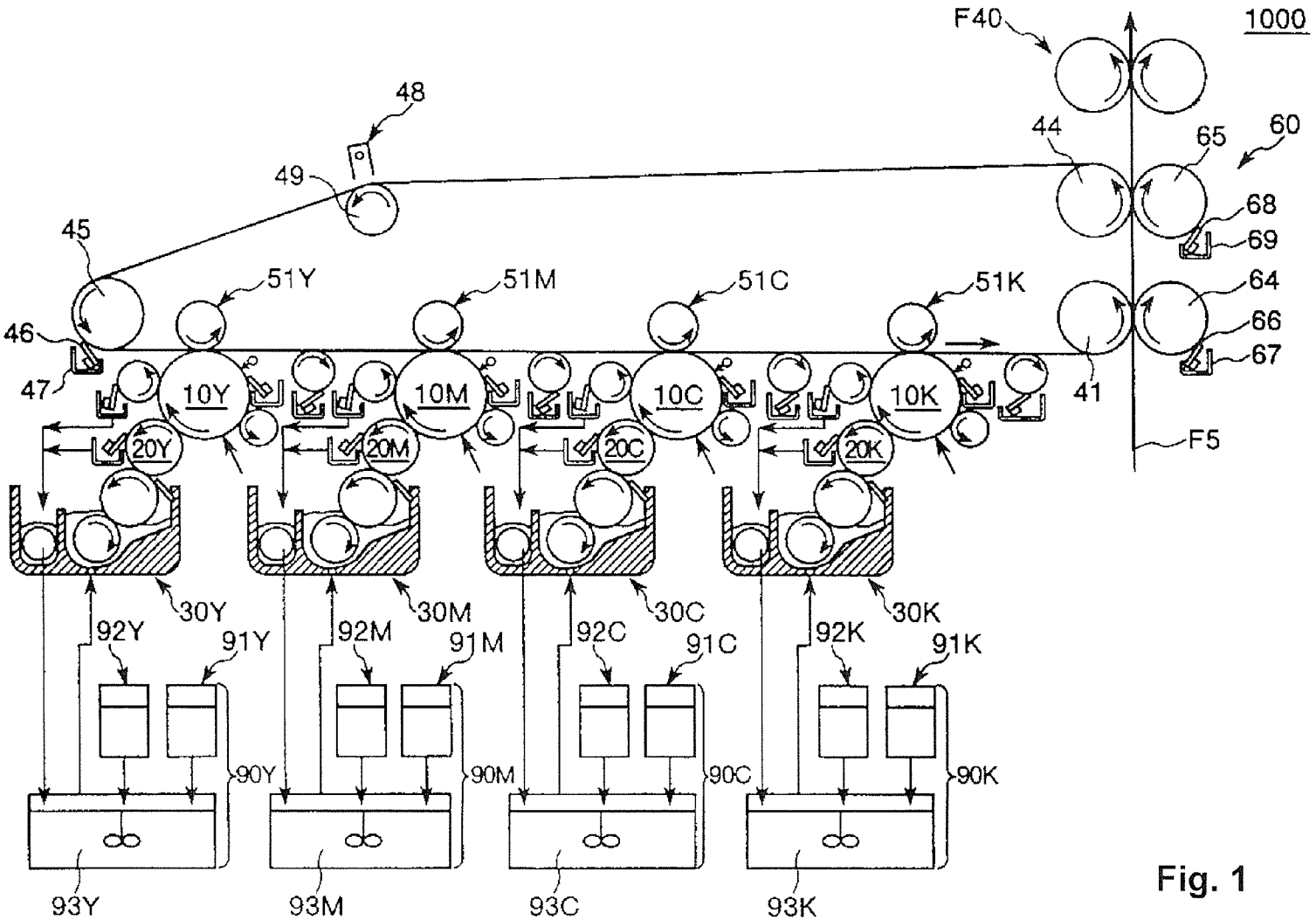
FIG. 1 is a schematic diagram illustrating an example of an image forming apparatus to which the developer of the invention is applied.

Preferred embodiments of the invention will now be described in detail.

Developer

First, the developer of the invention will be described. The developer of the invention contains toner particles and an insulating liquid, a fatty acid ester is contained as the insulating liquid, a substance A expressed by the following formula (1) and/or a substance B expressed by the following formula (2) is further contained, and the total percentage in which substance A and substance B are contained is at least 0.1 wt % and no more than 3.0 wt %.

[Fourth Chemical Formula]

$$R—O—(AO)_n—H \quad (1)$$

(In Formula 1, R is a phenyl group, a styrylated phenyl group, an α-naphthyl group, or a β-naphthyl group, A is an alkylene group, and n is an integer of at least 1.)

[Fifth Chemical Formula]

$$(RO)_n—\overset{\overset{\displaystyle O}{\|}}{P}—(OH)_{3-n} \quad (2)$$

(In Formula 2, R is an organic group having a carbon number of at least 1 and no more than 15, and n is an integer of at least 1 and no more than 3.)

Thus, the invention is characterized by the fact that a substance A and/or a substance B is contained in a specific quantity along with a fatty acid ester as the insulating liquid. With this constitution, the developer will be compatible with high-speed developing, and the positive charging characteristics and charge stability of the toner particles will be excellent. With the invention, just substance A or substance B can be contained, but it is particularly favorable for both substance A and substance B to be contained. This makes the developer even more compatible with high-speed developing, results in the positive charging characteristics and charge stability of the toner particles being even better, affords particularly excellent dispersion stability of the toner in the developer (the insulating liquid), and affords particularly excellent storage stability of the developer.

The reason why the excellent effects mentioned above are obtained seems to be as follows. Usually, substance A, or the majority thereof, adheres to the surface of the toner particles in the developer, and substance B completely dissolves in the insulating liquid, with substance A functioning as an electron donor and substance B as an electron acceptor, and with charge exchange being carried out favorably between substance A, the fatty acid ester (insulating liquid) having a polar group, and substance B. As a result, the positive charging of the toner particles is excellent, and there is a marked increase in electrophoresis.

In contrast, this does not happen if the sum of the content percentages of substance A and substance B is not within the specified range. Specifically, if the sum of the content percentages of substance A and substance B in the developer is less than the above-mentioned lower limit, there will be a pronounced decrease in the positive charging characteristics and charge stability of the toner particles, the mobility (movement speed) of the toner particles in the developer will decrease markedly, and application to high-speed developing will be difficult. Also, if the sum of the content percentages of substance A and substance B in the developer is over the above-mentioned upper limit, there will be a pronounced decrease in the positive charging characteristics and charge stability of the toner particles, the mobility (movement speed) of the toner particles in the developer will decrease markedly, application to high-speed developing will be difficult, and the storage stability of the developer will be markedly diminished.

As discussed above, with the invention, the sum of the content percentages of substance A and substance B in the developer is at least 0.1 wt % and no more than 3.0 wt %, with at least 0.2 wt % and no more than 2.0 wt % being preferable, and at least 0.3 wt % and no more than 1.5 wt % being even better. Consequently, the above-mentioned effect will be even more pronounced. Also, if we let $X_A$ be the content (wt %) of substance A and $X_B$ the content (wt %) of substance B, it is preferable to satisfy the relation $0.01 \leq X_A/(X_A+X_B) \leq 0.99$, and more preferable to satisfy the relation $0.25 \leq X_A/(X_A+X_B) \leq 0.75$, and even more preferable to satisfy the relation $0.33 \leq X_A/(X_A\ X_B) \leq 0.67$. Satisfying this relation affords particularly excellent positive charging characteristics and charge stability of the toner particles, while resulting in particularly excellent mobility of the toner particles, so the developer is even more compatible with high-speed developing.

Toner Particles

Constituent Materials of Toner Particles

The toner particles contain at least a binder resin (resin material) and a colorant.

1. Resin Material (Binder Resin)

Examples of the resin material constituting the toner particles include polyester resins, styrene-acrylic ester copolymers, methacrylic resins, epoxy resins, and rosin-based resins, of which polyester resins are preferable. Polyester resins have good transparency, and when they are used as a binder resin, the resulting images have good color expression. Also, the toner particles are fixed particularly well to the recording medium. If the toner particles are made up of a material containing a polyester resin, the color expression of the resulting images will be particularly outstanding. With a well-known developer, it was especially difficult to achieve a positive charge when the toner particles were made up of a polyester resin, but with the invention, even if the toner particles are made up of a polyester resin, the positive charging characteristics and charge stability will be completely satisfactory. Specifically, the effect of the invention will be particularly pronounced when the toner particles are made up of a material containing a polyester resin.

When a polyester resin is contained, the acid value of the polyester resin is preferably at least 5 mg KOH/g and no more than 20 mg KOH/g, with at least 5 mg KOH/g and no more than 15 mg KOH/g being particularly favorable. The percentage content of the polyester resin in the resin material is preferably at least 50 wt % and no more than 99 wt %, with at least 60 wt % and no more than 95 wt % being particularly favorable. Examples of rosin-based resins include rosin-modified phenol resins, rosin-modified maleic resins, rosin-modified polyester resins, fumaric acid-modified rosin resins, and ester gums. Just one of these or a combination of two or more types can be used.

The glass transition temperature (Tg) of the resin material used in the invention is preferably at least 15° C. and no more than 70° C., with at least 20° C. and no more than 55° C. being even better. In this Specification, the term "glass transition temperature" refers to the temperature at the intersection between an extension of a baseline under the glass transition temperature when measured with a DSC-22C differential scanning calorimeter (made by SII) under measurement conditions including a sample amount of 10 mg, a temperature elevation rate of 10° C./min, and a measurement temperature range of 10 to 150° C., and the tangent indicating the maximum slope from the rising portion of the peak to the apex of the peak.

There are no particular restrictions on the softening point (T1/2) of the resin material, but it is preferably at least 50° C. and no more than 130° C., with at least 50° C. and no more than 120° C. being more preferable, and at least 60° C. and no more than 115° C. being even better. In this Specification, the term "softening point" refers to the softening commencement temperature measured with a Koka-type flow tester (made by Shimadzu) under measurement conditions including a temperature elevation rate of 5° C./min and a die aperture of 1.0 mm.

2. Colorant

The toner particles can also contain a colorant. There are no particular restrictions on the colorant, and any known pigments, dyes, and so forth can be used, for example.

3. Other Components

The toner particles can also contained components other than those listed above. Examples of such components include known waxes and magnetic powders. In addition to the materials discussed above, the constituent materials (components) of the toner particles can also included, for example, zinc stearate, zinc oxide, cerium oxide, silica, titanium oxide, iron oxide, fatty acids, fatty acid metal salts, and the like.

Shape of Toner Particles

The average particle size of the toner particles constituted by the above materials is preferably at least 0.5 μm and no more than 5.0 μm, with at least 1 μm and no more than 3.5 μm being preferable, and at least 1 μm and no more than 2.5 μm being even better. If the average particle size of the toner particles is within the above range, there will be little variance in the characteristics from one toner particle to the next, the developer as a whole will have better reliability, and the resolution of the toner images formed by the developer will be sufficiently high. This also improves the dispersion of the toner particles in the insulating liquid, and provides good storage stability of the developer. In this Specification, the term "average particle size" refers to the average particle size by volumetric standard. The percentage content of the toner particles in the developer is preferably at least 10 wt % and no more than 60 wt %, with at least 20 wt % and no more than 50 wt % being even better.

Insulating Liquid

The insulating liquid functions as a dispersion medium for dispersing the toner particles in the developer. The insulating liquid also has good insulating properties in order to transfer the charged toner particles during image formation. The insulating liquid can be any liquid with good insulating properties, but more specifically it preferably has an electrical resistance at room temperature of at least $1\times10^{9}$ Ωcm, with $1\times10^{11}$ Ωcm being more preferable, and $1\times10^{13}$ Ωcm being even better. The dielectric constant of the insulating liquid is preferably no more than 3.5.

The developer of the invention contains a fatty acid ester as the insulating liquid. When a fatty acid ester is contained, charge conversion can be carried out efficiently with substance A and/or substance B (discussed below in detail), and the product will be compatible with high-speed developing. Also, the dispersion stability of the toner in the developer (insulating liquid) will be particularly excellent, and the storage stability of the developer will also be particularly excellent. These outstanding effects will not be obtained if some other insulating liquid is used in place of a fatty acid ester.

Any fatty acid ester can be used as long as it has an ester structure with the alcoholic hydroxyl group and carboxyl group constituting the fatty acid in the molecule, but examples include fatty acid glycerides, fatty acid monoesters, medium-chain fatty acid esters, and other such fatty acid esters, and vegetable oils containing these. The fatty acid component constituting the fatty acid ester can be one having at least one carboxyl group in the molecule, and a monovalent fatty acid, a divalent fatty acid, or a polyvalent (trivalent or higher) fatty acid can be used. The alcohol constituting the fatty acid ester can be one having at least one alcoholic hydroxyl group in the molecule, and a monohydric alcohol, a dihydric alcohol, or a polyhydric (trihydric or higher) alcohol can be used.

With the invention, the fatty acid ester can be a standard type, or can be a lipid (vegetable oil or animal oil), or can be a fatty acid ester obtained by ester exchange reaction between one of these lipids and an alcohol, a fatty acid ester obtained by ester exchange reaction between one of these fatty acid esters and an alcohol, a fatty acid ester obtained by esterification reaction between one of these fatty acids and an alcohol, or another such processed oil.

Of these, the fatty acid ester is preferably an ester of a monovalent fatty acid and a monohydric alcohol (a fatty acid monoester). This will result in particularly excellent dispersion stability of the toner particles in the insulating liquid and charge stability, while also affording particularly excellent mobility of the toner particles, and better compatibility with high-speed developing. A fatty acid monoester can be obtained, for example, by ester exchange reaction between a vegetable oil and a monohydric alcohol. Examples of vegetable oils that can be used in the ester exchange reaction include soybean oil, rapeseed oil, dehydrogenated castor oil, tung oil, safflower oil, linseed oil, sunflower oil, corn oil, cottonseed oil, sesame oil, hemp oil, evening primrose oil, palm oil (and particularly palm kernel oil), and coconut oil.

A fatty acid monoester can also be produced by ester exchange reaction between various kinds of saturated fatty acids or unsaturated fatty acids and a monohydric alcohol, dihydric alcohol, or polyhydric alcohol. Also, the fatty acid ester is preferably an ester of a fatty acid and a straight-chain alcohol. This affords particularly excellent charging characteristics of the toner particles and dispersion stability in the insulating liquid, while also affording particularly excellent mobility of the toner particles, so that the product is even more compatible with high-speed developing. Also, the fatty acid ester is preferably an ester of a fatty acid and an alcohol with a carbon number of at least 4 and no more than 14. This affords particularly excellent charging characteristics of the toner particles and dispersion stability in the insulating liquid, while also affording particularly excellent mobility of the toner particles, so that the product is even more compatible with high-speed developing.

The developer of the invention can contain components other than fatty acid esters (other insulating liquid components) as a constituent component of the insulating liquid. In this case, the proportion of the total insulating liquid accounted for by the other insulating liquid components is preferably no more than 10 wt %, with 5 wt % or less being even better. Examples of other insulating liquid components include dimethyl silicone oils such as KF-99, KF-96, KF-995 (Shin-Etsu Chemical Co.), AK35, AK50, AK100, AK350, AK1000 (Wacker Chemie AG), and SH200, SH510, and SH8400 (Dow Corning Toray Co.); silicone oils having a degree of polymerization of more than 20, such as hydrogen-modified silicone compounds; low-molecular-weight siloxane compounds having a degree of polymerization of 20 or less, including cyclic siloxane compounds such as cyclopentane siloxane and decamethylcyclopentane siloxane, and methyltris(trimethylsiloxy)silane; mineral oils (liquid hydrocarbons) such as Isopar E, Isopar G, Isopar H, Isopar L ("Isopar" is a trade name of the Exxon Chemical Company), Shellsol 70, Shellsol 71 ("Shellsol" is a trade name of Shell Chemicals), Amsco OMS, Amsco 460 solvent ("Amsco" is a trade name of the American Mineral Spirits Company), and low- and high-viscosity liquid paraffins (Wako Pure Chemical Industries); and octane, isooctane, decane, isodecane, decalin, nonane, dodecane, isododecane, cyclohexane, cyclooctane, cyclodecane, benzene, toluene, xylene, mesitylene, butyl acetate, and isopropanol. These can be used alone or in combinations of two or more types.

There are no particular restrictions on the viscosity of the insulating liquid, but it is preferably at least 5 mPa·s and no more than 1000 mPa·s, with at least 50 mPa·s and no more than 800 mPa·s being more preferable, and at least 100 mPa·s and no more than 500 mPa·s being even better. If the viscosity of the insulating liquid is within the above range, the developer can be supplied from a developer container onto an coating roller with an appropriate amount of insulating liquid adhering to the toner particles, thus providing particularly excellent toner image development properties and transfer properties. In addition, clumping and settling of the toner particles can be more effectively prevented, and the dispersibility of the toner particles in the insulating liquid can be improved. The term "viscosity" in this Specification refers to the value measured at 25° C.

The developer of the invention contains substance A and/or substance B. substance A and substance B will now be described.

Substance A

Substance A has the structure expressed by the above-mentioned Formula 1. If a specific amount of substance A is contained along with the above-mentioned fatty acid ester, the developer will be compatible with high-speed developing, and the positive charging characteristics and charge stability of the toner particles will be excellent. Also, the dispersion stability of the toner in the developer (insulating liquid) will be particularly excellent, as will the storage stability of the developer.

Substance A is not readily miscible with a fatty acid ester because it has a polyoxyalkylene group, and it is believed that the majority thereof usually adheres to the surface of the toner particles in the developer, and functions as an electron donor. Charging seems to occur due to charge conversion between the fatty acid ester that is the insulating liquid and the substance A adhering to the particle surface. The developer of the invention can contain a plurality of types of compound expressed by different structural formulas as substance A. In this case, the sum of the content percentages of these compounds shall be the percentage content of substance A.

Substance A is preferably one having a polyoxyethylene structure (in which A in Formula 1 is an ethylene group). Consequently, the dispersion stability of the toner particles in the insulating liquid and their charging stability will be particularly excellent, while the mobility of the toner particles will also be particularly excellent, and the product will be more compatible with high-speed developing. It is also preferable for R in Formula 1 to be a styrylated phenyl group, and more preferably a monostyrylated phenyl group. Consequently, the dispersion stability of the toner particles in the insulating liquid and their charging stability will be particularly excellent, while the mobility of the toner particles will also be particularly excellent, and the product will be more compatible with high-speed developing.

As long as the sum of the percentage contents of substance A and substance B is a value within the above range, there are no particular restrictions on the percentage content of substance A, but if the developer contains substance B along with substance A, the percentage content of substance A in the developer is preferably at least 0.01 wt % and no more than 2.97 wt %, with at least 0.05 wt % and no more than 1.5 wt % being more preferable, and at least 0.1 wt % and no more than 1.0 wt % being even better. Consequently, the dispersion stability of the toner particles in the insulating liquid and their charging stability will be particularly excellent, while the mobility of the toner particles will also be particularly excellent, so that high-speed developing can be handled even more favorably. Also, if the developer contains substance A but not substance B, the percentage content of substance A in the developer is preferably at least 0.2 wt % and no more than 2.0 wt %, with 0.3 wt % and no more than 1.5 wt % being more preferable. This results in the above-mentioned effects being even more pronounced.

Substance B

Substance B has a structure expressed by the above-mentioned Formula 2. Substance B usually dissolves completely in the insulating liquid (fatty acid ester), and functions as an electron acceptor. It is believed that this causes the toner particles to exhibit a positive charge and markedly enhances electrophoresis.

If a specific amount of substance B is contained along with the above-mentioned fatty acid ester, the developer will be compatible with high-speed developing, and the positive charging characteristics and charge stability of the toner particles will be excellent. Also, the dispersion stability of the toner in the developer (insulating liquid) will be particularly excellent, and the storage stability of the developer will also be particularly excellent. The developer of the invention can contain a plurality of types of compound expressed by different structural formulas as substance B. In this case, the total percentage content of these compounds shall be termed the percentage content of substance B.

Substance B can have a hydrocarbon group with a branched chain. Consequently, the charge stability of the toner particles and their dispersion stability in the insulating liquid will be particularly excellent, and the mobility of the toner particles will also be particularly excellent, so that high-speed developing can be handled more favorably. Also, substance B can have a straight-chain alkyl group with a carbon number of at least 4 and no more than 12. Consequently, the charge stability of the toner particles and their dispersion stability in the insulating liquid will be particularly excellent, and the mobility of the toner particles will also be particularly excellent, so that high-speed developing can be handled more favorably. Also, substance B can be one expressed by the following formula (3).

[Sixth Chemical Formula]

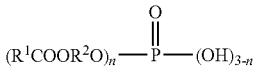

$$(R^1COOR^2O)_n-\overset{\overset{\displaystyle O}{\|}}{P}-(OH)_{3-n} \quad (3)$$

(In Formula 3, $R^1$ is a hydrocarbon group with a carbon number of at least 1 and no more than 7, and $R^2$ is a hydrocarbon group with a carbon number of at least 1 and no more than 7.)

Consequently, the charge stability of the toner particles and their dispersion stability in the insulating liquid will be particularly excellent, and the mobility of the toner particles will also be particularly excellent, so that high-speed developing can be handled more favorably. If substance B is expressed by Formula 3, $R^1$ in Formula 3 preferably has an unsaturated bond. Consequently, the charge stability of the toner particles and their dispersion stability in the insulating liquid will be even better, and the mobility of the toner particles will also be even better, so that high-speed developing can be handled even more favorably.

As long as the sum of the percentage contents of substance A and substance B is a value within the above range, there are no particular restrictions on the percentage content of substance B, but if the developer contains substance B along with substance A, the percentage content of substance B in the developer is preferably at least 0.01 wt % and no more than 2.97 wt %, with at least 0.05 wt % and no more than 1.5 wt % being more preferable, and at least 0.1 wt % and no more than 1.0 wt % being even better. Consequently, the dispersion stability of the toner particles in the insulating liquid and their charging stability will be even better, while the mobility of the toner particles will also be even better, so that high-speed developing can be handled even more favorably. Also, if the developer contains substance B but not substance A, the percentage content of substance B in the developer is preferably at least 0.2 wt % and no more than 2.0 wt %, with 0.3 wt % and no more than 1.5 wt % being more preferable. This results in the above-mentioned effects being even more pronounced.

Other Components

The developer can also contain other components besides those discussed above. Examples of such components include known dispersants, antioxidants, and charge control agents. These components can adhere to the toner particles, or they can be dispersed or dissolved in the insulating liquid.

Method for Manufacturing Developer

The method for manufacturing the developer of the invention will now be described. The method for manufacturing the developer of the invention includes a wet pulverization step in which a powder made up of a material containing a resin material and a colorant is subjected to wet pulverization in a ball mill, bead mill, or the like to obtain a dispersion, and a bead removal step in which the beads used in the ball mill, bead mill, etc., are removed. The above-mentioned developer can be manufactured efficiently by using such a method.

Wet Pulverization Step

In this step, the power that is subjected to wet pulverization can be any one that is constituted by a material containing a resin material and a colorant, but is preferably obtained by pulverizing a mixture obtained by kneading a material containing a resin material and a colorant. This affords particularly excellent uniformity in the characteristics from one toner particle to the next. Also, substance A and substance B can be contained in the material subjected to wet pulverization, or can be added after this step.

A twin-screw kneader extruder, a kneader, a batch-type triaxial roll, a continuous biaxial roll, a wheel mixer, a blade mixer, or any of various other kinds of kneading machine can be used for this kneading. This step is performed using a ball mill, bead mill, or the like, and the beads (balls) used here can be made of zirconia, alumina, glass, chromium steel, or the like.

In this step, the above-mentioned powder is pulverized into microparticles, and the dispersibility of the toner particles is enhanced. In particular, if this step is performed in the presence of substance A, then substance A will adhere well around the surface of the microparticle powder (toner particles). Consequently, the above-mentioned effects produced by the invention can be manifested more reliably. Also, if this step is performed in the presence of substance B, charging and dispersion of the toner particles can both be carried out at a higher level.

Bead Removal Step

After this, the beads (balls) are removed from the dispersion obtained in the wet pulverization step. This yields a developer. The removal of the beads can be accomplished by filtration, for example. The beads can also be allowed to settle, and the supernatant used as the developer.

Image Forming Apparatus

Next, a preferred embodiment of an image forming apparatus to which the developer of the invention is applied will be described. FIG. 1 is a schematic diagram illustrating an example of an image forming apparatus to which the developer of the invention is applied, and FIG. 2 is a detail enlargement of part of the image forming apparatus shown in FIG. 1.

Figure 2:
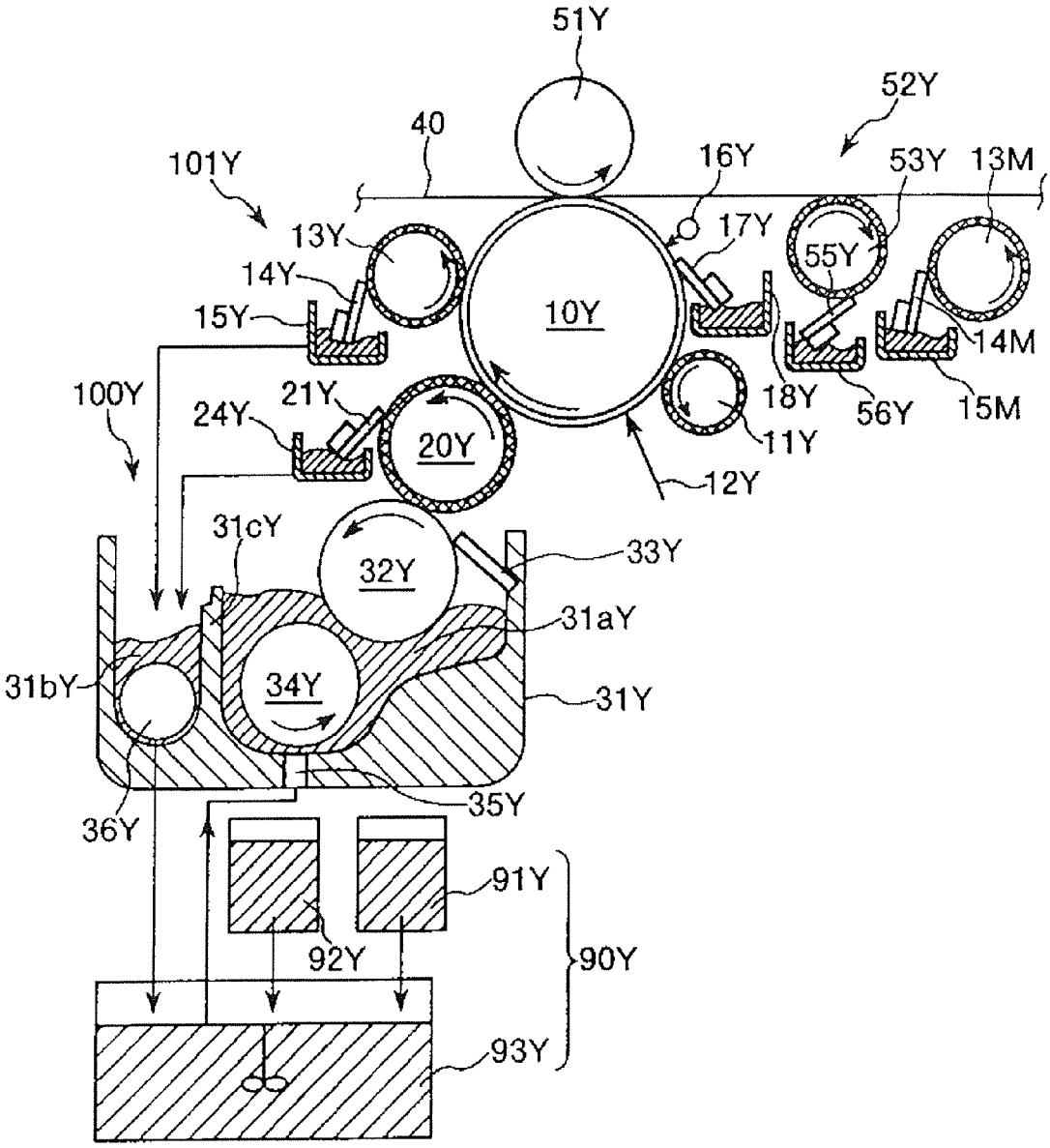
FIG. 2 is a detail enlargement of part of the image forming apparatus shown in FIG. 1.

As shown in FIGS. 1 and 2, an image forming apparatus 1000 includes four developing components 30Y, 30M, 30C, and 30K, a transfer component (intermediate transfer component 40 and secondary transfer unit (secondary transfer component) 60), a fixing component (fixing apparatus) F40, and four developer supply components 90Y, 90M, 90C, and 90K. The developing components 30Y, 30M, and 30C have the function of developing latent images with a yellow developer (Y), a magenta developer (M), and a cyan developer (C), respectively, to form monochrome images corresponding to each color. The developing component 30K has the function of developing a latent image with a black developer (K) to form a black monochrome image.

Since the developing components 30Y, 30M, 30C, and 30K have the same configuration, just the developing component 30Y will be described below. As shown in FIG. 2, the developing component 30Y includes a photoreceptor 10Y (an example of an image carrier), and, in the rotational direction of the photoreceptor 10Y, a charging roller 11Y, an exposure unit 12Y, a developing unit 100Y, a photoreceptor squeeze apparatus 101Y, a primary transfer backup roller 51Y, a neutralizing unit 16Y, a photoreceptor cleaning blade 17Y, and a developer recovery component 18Y.

The photoreceptor 10Y includes a cylindrical substrate and a photoreceptor layer disposed on the outer peripheral face thereof and formed from a material such as amorphous silicon, and is rotatable around the central. In this embodiment, the photoreceptor 10Y rotates clockwise, as indicated by the arrow in FIG. 2. The photoreceptor 10Y is supplied with a developer from the developing unit 100Y (discussed below), so that a layer of the developer is formed on its surface.

The charging roller 11Y is an apparatus for charging the photoreceptor 10Y. The exposure unit 12Y is an apparatus for irradiating the charged photoreceptor 10Y with a laser beam to form a latent image thereon. The exposure unit 12Y has a semiconductor laser, a polygon mirror, and an F-θ lens, and so forth and irradiates the charged photoreceptor 10Y with a laser modulated on the basis of an image signal inputted from a host computer (not shown) such as a personal computer or a word processor. The developing unit 100Y is an apparatus for developing the latent image formed on the photoreceptor 10Y, using the developer of the invention. The developing unit 100Y will be discussed in detail below.

The photoreceptor squeeze apparatus 101Y is disposed opposite the photoreceptor 10Y on the downstream side of the developing unit 100Y in the rotational direction, and is constituted by a photoreceptor squeeze roller 13Y, a cleaning blade 14Y for removing the developer adhering to the surface of the photoreceptor squeeze roller 13Y by sliding over it with pressure, and a developer recovery component 15Y for recovering the removed developer. This photoreceptor squeeze unit 101Y has the function of recovering excess carrier (insulating liquid) and unwanted fog toner from the developer deposited on the photoreceptor 10Y, and increasing the proportion of toner particles in the visible image.

The primary transfer backup roller 51Y is an apparatus for transferring the monochrome image formed on the photoreceptor 10Y onto the intermediate transfer component 40 (discussed below). The neutralizing unit 16Y is an apparatus for removing residual charge from the photoreceptor 10Y after the primary transfer backup roller 51Y has transferred the intermediate transfer image onto the intermediate transfer component 40. The photoreceptor cleaning blade 17Y is a rubber member in contact with the surface of the photoreceptor 10Y, and has the function of scraping residual developer off the photoreceptor 10Y after the primary transfer backup roller 51Y has transferred the image onto the intermediate transfer component 40. The developer recovery component 18Y has the function of recovering the developer removed by the photoreceptor cleaning blade 17Y.

The intermediate transfer component 40 is an endless elastic belt member running around a belt drive roller 41 to which the drive force of a motor (not shown) is transmitted and a pair of driven rollers 44 and 45. The intermediate transfer component 40 is rotationally driven counterclockwise by the belt drive roller 41 while in contact with the photoreceptors 10Y, 10M, 10C, and 10K at the primary transfer backup rollers 51Y, 51M, 51C, and 51K, respectively.

In addition, a tension roller 49 applies a specific tension to the intermediate transfer component 40 to take up slack. This tension roller 49 is disposed on the downstream side of one driven roller 44 in the rotational (movement) direction of the intermediate transfer component 40 and on the upstream side of the other driven roller 45 in the rotational (movement) direction of the intermediate transfer component 40. The monochrome images corresponding to the respective colors formed by the developing components 30Y, 30M, 30C, and 30K are sequentially transferred onto the intermediate transfer component 40 by the primary transfer backup rollers 51Y, 51M, 51C, and 51K so as to be superimposed on each other. This forms a full-color developer image (intermediate transfer image) on the intermediate transfer component 40.

The monochrome images formed on the photoreceptors 10Y, 10M, 10C, and 10K are thus sequentially and secondarily transferred, superimposed, and carried by the intermediate transfer component 40, and are secondarily transferred all at once onto a recording medium F5 such as paper, film, or cloth by the secondary transfer unit 60 (discussed below). Accordingly, an elastic belt member is employed as the means for improving secondary transfer characteristics so that the transfer will conform to the surface of a non-smooth sheet material, even when the surface of the recording medium F5 makes up of a fibrous sheet or other sheet material that is not smooth, when transferring the toner image to the recording medium F5 in the secondary transfer step.

The intermediate transfer component 40 also is provided with a cleaning apparatus including an intermediate transfer component cleaning blade 46, a developer recovery component 47, and a non-contact biasing member 48. The intermediate transfer component cleaning blade 46 and the developer recovery component 47 are disposed on the driven roller 45 side. The intermediate transfer component cleaning blade 46 has the function of scraping off residual developer adhering to the intermediate transfer component 40 after the secondary transfer unit (secondary transfer component) 60 has transferred the toner image onto the recording medium F5. The developer recovery component 47 has the function of recovering the developer scraped off by the intermediate transfer component cleaning blade 46.

The non-contact biasing member 48 is disposed away from the intermediate transfer component 40 opposite the tension roller 49. The non-contact biasing member 48 applies to the toner a bias voltage that is opposite in polarity to that of the toner (solid) in the developer remaining on the intermediate transfer component 40 after secondary transfer. This neutralizes the toner, thus reducing the electrostatic force that causes the toner to adhere to the intermediate transfer component 40. In this example, a corona charger is used as the non-contact biasing member 48.

The non-contact biasing member 48 does not necessarily have to be disposed at a position opposite the tension roller 49, and can instead be disposed at any position downstream from the driven roller 44 in the movement direction of the intermediate transfer component 40 and upstream from the driven roller 45 in the movement direction of the intermediate transfer component 40, such as at a position between the driven roller 44 and the tension roller 49. A known non-contact charger other than a corona charger can also be used for the non-contact biasing member 48.

Also, an intermediate transfer component squeeze apparatus 52Y is disposed on the downstream side of the primary transfer backup roller 51Y in the movement direction of the intermediate transfer component 40. This intermediate transfer component squeeze apparatus 52Y is provided as a means for removing excess insulating liquid from the developer transferred onto the intermediate transfer component 40 if the transferred developer is not in a favorable state of dispersion.

The intermediate transfer component squeeze apparatus 52Y is constituted by an intermediate transfer component squeeze roller 53Y, an intermediate transfer component squeeze cleaning blade 55Y for cleaning the surface of the intermediate transfer component squeeze roller 53Y by sliding over it with pressure, and a developer recovery component 56Y for recovering the developer removed by the intermediate transfer component squeeze cleaning blade 55Y. The intermediate transfer component squeeze apparatus 52Y has the function of recovering excess insulating liquid from the developer primarily transferred onto the intermediate transfer component 40, increasing the proportion of toner in the image, and recovering unwanted fog toner.

The secondary transfer unit 60 includes a pair of secondary transfer rollers disposed spaced apart at a specific interval in the movement direction of the transfer material. Of the pair of secondary transfer rollers, the one disposed on the upstream side in the movement direction of the intermediate transfer component 40 is an upstream secondary transfer roller 64. The upstream secondary transfer roller 64 can be pressed against the belt drive roller 41 with the intermediate transfer component 40 in between.

Of the pair of secondary transfer rollers, the one disposed on the downstream side in the movement direction of the transfer material is a downstream secondary transfer roller 65. The downstream secondary transfer roller 65 can be pressed against the driven roller 44 with the intermediate transfer component 40 in between. That is, the upstream secondary transfer roller 64 and the downstream secondary transfer roller 65 bring the recording medium F5 into contact with the intermediate transfer component 40 at the belt drive roller 41 and the driven roller 44, respectively, and secondarily transfer the intermediate transfer image, formed on the intermediate transfer component 40 by superimposing the colors, onto the recording medium F5.

In this case, the belt drive roller 41 and the driven roller 44 also function as backup rollers for the upstream secondary transfer roller 64 and the downstream secondary transfer roller 65, respectively. That is, the belt drive roller 41 also serves as an upstream backup roller disposed on the upstream side of the driven roller 44 in the movement direction of the recording medium F5 in the secondary transfer unit 60. The driven roller 44 also serves as a downstream backup roller disposed on the downstream side of the belt drive roller 41 in the movement direction of the recording medium F5 in the secondary transfer unit 60.

Therefore, the recording medium F5 that has been conveyed to the secondary transfer unit 60 is brought into close contact with the intermediate transfer component 40 in a specific transfer material movement region from a pressing commencement position (nip commencement position) between the upstream secondary transfer roller 64 and the belt drive roller 41, to a pressing termination position (nip termination position) between the downstream secondary transfer roller 65 and the driven roller 44. This allows the full-color intermediate transfer image on the intermediate transfer component 40 to be secondarily transferred over a specific length of time onto the recording medium F5 in a state in which the recording medium F5 is in close contact with the intermediate transfer component 40, so good secondary transfer is carried out.

The secondary transfer unit 60 also includes a secondary transfer roller cleaning blade 66 and a developer recovery component 67 for the upstream secondary transfer roller 64. The secondary transfer unit 60 further includes a secondary transfer roller cleaning blade 68 and a developer recovery component 69 for the downstream secondary transfer roller 65. The secondary transfer roller cleaning blades 66 and 68 come into contact with the secondary transfer rollers 64 and 65, respectively, to scrape residual developer off the surfaces of the secondary transfer rollers 64 and 65 following secondary transfer. The developer recovery components 67 and 69 also recover and hold the developer scraped off the secondary transfer rollers 64 and 65 by the secondary transfer roller cleaning blades 66 and 68, respectively.

The toner image (transfer image) transferred onto the recording medium F5 by the secondary transfer unit 60 is sent to the fixing component (fixing unit) F40, where it is heated and pressed and thereby fixed onto the recording medium F5. The fixing temperature (set temperature) is preferably at least 80° C. and no more than 160° C., with at least 100° C. and no more than 150° C. being more preferable, and at least 100° C. and no more than 140° C. being even better.

Next, the developing units 100Y, 100M, 100C, and 100K will be described in detail. In the description that follows, the developing unit 100Y will be described as a representative example. As shown in FIG. 2, the developing unit 100Y has a developer reservoir 31Y, a coating roller 32Y, a regulating blade 33Y, a developer stirring roller 34Y, a communication component 35Y, a recovery screw 36Y, a developing roller 20Y, and a developing roller cleaning blade 21Y.

The developer reservoir 31Y has the function of holding a developer for developing a latent image formed on the photoreceptor 10Y, and includes a supply component 31*a*Y for supplying the developer to the developing component, a recovery component 31*b*Y for recovering excess developer generated at the supply component 31*a*Y and so forth, and a partition 31*c*Y separating the supply component 31*a*Y and the recovery component 31*b*Y. The supply component 31*a*Y has the function of supplying the developer to the coating roller 32Y, and has a recessed portion in which the developer stirring roller 34Y is installed. The supply component 31*a*Y is also supplied with the developer from a developer mixing vessel 93Y through the communication component 35Y. The recovery component 31*b*Y also collects excess developer supplied to the supply component 31*a*Y and excess developer collected by the developer recovery components 15Y and 24Y. The collected developer is conveyed to the developer mixing vessel 93Y (discussed below) and reused. The recovery component 31*b*Y also has a recess, near the bottom of which is installed the recovery screw 36Y.

The wall-shaped partition 31*c*Y is provided at the boundary between the supply component 31*a*Y and the recovery component 31*b*Y. The partition 31*c*Y separates the supply component 31*a*Y and the recovery component 31*b*Y to prevent contamination of fresh developer with the recovered developer. Also, if excess developer is supplied to the supply component 31*a*Y the excess developer can spill over from the supply component 31*a*Y into the recovery component 31*b*Y past the partition 31*c*Y. This keeps the developer at a constant level in the supply component 31*a*Y and therefore keeps the amount of developer supplied to the coating roller 32Y steady. Accordingly, the image that is ultimately formed has more stable image quality. Also, the partition 31*c*Y is provided with a cut-out through which the developer can spill out of the supply component 31*a*Y into the recovery component 31*b*Y.

The coating roller 32Y has the function of supplying the developer to the developing roller 20Y. The coating roller 32Y is what is known as an anilox roller, that is, an iron or other such metal roller having grooves formed evenly and spirally on its surface and plated with nickel, and has a diameter of about 25 mm. In this embodiment, a plurality of grooves are formed diagonally to the rotational direction of the coating roller 32Y by cutting, rolling, or other such working. The coating roller 32Y rotates counterclockwise while in contact with the developer, and thereby carries in its grooves the developer inside the supply component 31*a*Y, and transports the developer to the developing roller 20Y.

The regulating blade 33Y hits the surface of the coating roller 32Y to regulate the amount of developer on the coating roller 32Y. That is, the regulating blade 33Y has the role of scraping excess developer off the coating roller 32Y to meter the amount of developer on the coating roller 32Y to be supplied to the developing roller 20Y. The regulating blade 33Y is composed of urethane rubber (an elastomer), and is supported by a regulating blade support member made of a metal such as iron. The regulating blade 33Y is provided on the side where the coating roller 32Y rotates out of the developer (that is, on the right side in FIG. 2). The JIS-A rubber hardness of the regulating blade 33Y is about 77 degrees, and the hardness (about 77 degrees) of the part of the regulating blade 33Y that hits the surface of the coating roller 32Y is lower than the hardness (about 85 degrees) of the part of an elastic layer of the developing roller 20Y (discussed below) that is pressed against the surface of the coating roller 32Y. The excess developer that has been scraped off is recovered by the supply component 31*a*Y for reuse.

The developer stirring roller 34Y has the function of stirring the developer to a uniformly dispersed state. This allows the toner particles to be well dispersed even after the some of the toner particles have clumped. In the supply component 31*a*Y, the toner particles in the developer are positively charged, and are stirred to a uniformly dispersed state by the developer stirring roller 34Y. As the coating roller 32Y rotates, the developer is pumped from the developer reservoir 31Y and supplied to the developing roller 20Y while the amount of developer is regulated by the regulating blade 33Y. The developer stirring roller 34Y stirs the developer so that it can stably spill over into the recovery component 31*b*Y past the partition 31*c*Y, thus preventing the developer from remaining behind and being compressed.

The developer stirring roller 34Y is provided near the communication component 35Y. Therefore, the developer supplied from the communication component 35Y can be quickly diffused, and the liquid level in the supply component 31*a*Y can be stabilized even when the supply component 31*a*Y is being refilled with the developer. Thus providing the developer stirring roller 34Y near the communication component 35Y puts the communication component 35Y under negative pressure and allows the developer to be pumped up naturally.

The communication component 35Y is a portion provided vertically below the developer stirring roller 34Y so as to communicate with the developer reservoir 31Y and to pump the developer from the developer mixing vessel 93Y into the supply component 31*a*Y. Because the communication component 35Y is provided beneath the developer stirring roller 34Y, the developer stirring roller 34Y stops the developer supplied from the communication component 35Y to keep the liquid level substantially constant, without a rise in liquid level due to blowoff, thus allowing the developer to be supplied stably to the coating roller 32Y. Also, the recovering screw 36Y, which is provided near the bottom of the recovery component 31*b*Y, makes up of a cylindrical member having a spiral rib around its outer periphery and having the function of maintaining the fluidity of the recovered developer, as well as the function of promoting conveyance of the developer to the developer mixing vessel 93Y.

The developing roller 20Y carries the developer and conveys it to a development position opposite the photoreceptor 10Y in order to develop the latent image supported by the photoreceptor 10Y with the developer. The developer is supplied from the coating roller 32Y described above to the surface of the developing roller 20Y to form a developer layer. The developing roller 20Y includes an inner core made of a metal such as iron and a conductive elastomer layer formed around the outer peripheral part thereof, and has a diameter of about 20 mm. The elastomer layer has a double-layer structure including an inner layer of urethane rubber having a JIS-A rubber hardness of about 30 degrees and a thickness of about 5 mm, and a surface layer (outer layer) of urethane rubber having a JIS-A rubber hardness of about 85 degrees and a thickness of about 30 μm. The surface layer serves as the pressing portion of the developing roller 20Y and is pressed against the coating roller 32Y and the photoreceptor 10Y in a state of elastic deformation.

The developing roller 20Y is rotatable around its central axis, and this central axis is below the central axis of rotation of the photoreceptor 10Y. The developing roller 20Y rotates in a direction (counterclockwise in FIG. 2) that is opposite to the rotational direction of the photoreceptor 10Y (clockwise in FIG. 2). An electric field is generated between the developing roller 20Y and the photoreceptor 10Y in developing the latent image formed on the photoreceptor 10Y. In the developing unit 100Y, the coating roller 32Y and the developing roller 20Y are separately driven by different power sources (not shown). The amount of developer supplied onto the developing roller 20Y can be adjusted by changing the ratio between the rotational speeds (linear speeds) of the coating roller 32Y and the developing roller 20Y.

The developing unit 100Y also has a developing roller cleaning blade 21Y made of rubber and in contact with the surface of the developing roller 20Y, and a developer recovery component 24Y. The developing roller cleaning blade 21Y is an apparatus for scraping off any developer that remains on the developing roller 20Y after development at the development position. The developer scraped off by the developing roller cleaning blade 21Y is recovered in the developer recovery component 24Y.

As shown in FIGS. 1 and 2, the image forming apparatus 1000 includes developer supply components 90Y, 90M, 90C, and 90K for respectively refilling the developing components 30Y, 30M, 30C, and 30K with developer. The developer supply components 90Y, 90M, 90C, and 90K respectively include developer tanks 91Y, 91M, 91C, and 91K, insulating liquid tanks 92Y, 92M, 92C, and 92K, and developer mixing vessels 93Y, 93M, 93C, and 93K.

The developer tanks 91Y, 91M, 91C, and 91K contain concentrated developers corresponding to the various colors. The insulating liquid tanks 92Y, 92M, 92C, and 92K contain insulating liquids. The developer mixing vessels 93Y, 93M, 93C, and 93K are supplied with specific amounts of concentrated developers from the developer tanks 91Y, 91M, 91C, and 91K, and specific amounts of insulating liquids from the insulating liquid tanks 92Y, 92M, 92C, and 92K.

In the developer mixing vessels 93Y, 93M, 93C, and 93K, the supplied concentrated developers and insulating liquids are mixed and stirred with built-in stirrers to produce developers corresponding to the various colors used in the supply components 31*a*Y, 31*a*M, 31*a*C, and 31*a*K. The developers produced in the developer mixing vessels 93Y, 93M, 93C, and 93K are supplied to the supply components 31*a*Y, 31*a*M, 31*a*C, and 31*a*K, respectively. The developer recovered by the recovery component 31*b*Y is recovered in the developer mixing vessel 93Y for reuse. The same applies to the developer mixing vessels 93M, 93C, and 93K.

Image formation using the above-mentioned apparatus entails a development step of forming a plurality of monochrome images corresponding to different colors on the photoreceptors 10Y, 10M, 10C, and 10K using a plurality of developers corresponding to different colors (the developers of the invention), a transfer step of forming an unfixed toner image by transferring the plurality of monochrome images formed on the photoreceptors onto the recording medium F5 so that the monochrome images are superimposed on the recording medium F5, and a fixing step of fixing the unfixed toner image onto the recording medium F5. Using this method allows an image with excellent color expression to be formed with ease.

The invention was described above on the basis of preferred embodiments, but is not limited to these. For example, the developer of the invention is not limited to being applied to the image forming apparatus described above. Also, the developer of the invention is not limited to being manufactured by the method described above. For example, the toner particles can be manufactured by a polymerization method or the like.

WORKING EXAMPLES

A1 Production of Developer

Developers were produced as follows. All the steps were carried out at room temperature (25° C.) unless otherwise specified.

Working Example A1

Wet Pulverization Step

First, a mixture (weight ratio of 85:15) of a polyester resin (acid value: 10 mg KOH/g; glass transition temperature (Tg): 55° C.; softening point: 107° C.) (as a resin material) and a cyan pigment (as a colorant) was prepared. These components were mixed in a 20 L Henschel mixer to prepare a raw material for toner manufacture. Next, this raw material (mixture) was kneaded using a twin-screw kneader extruder. The kneaded material extruded from the extrusion port of the twin-screw kneader extruder was cooled. The kneaded material thus cooled was coarsely crushed into a coarse toner particle raw material having an average particle size of no more than 1.0 mm. A hammer mill was used for the coarse crushing of the kneaded material.

50 g of the coarsely crushed particles obtained by the above method, 1.0 g of polyoxyethylene monostyryl phenyl ether (as substance A), and 150 g of butyl oleate (as an insulating liquid; a fatty acid ester) were put in a ceramic pot (600 mL internal volume). Zirconia beads (ball diameter of 1 mm) were then added to the ceramic pot so that the volumetric filler ratio would be 40%, and wet pulverization was performed for 48 hours at 230 rpm in a tabletop pot mill.

Bead Removal Step

After this, the zirconia beads were removed by suction filtration to obtain a developer. The viscosity at 25° C. of the developer thus obtained was 478 mPa·s. The volumetric average particle size ($D_{50}$) of the toner particles was 2.42 μm. The viscosity at 25° C. of the developer was found at a shear rate of 5.0 $sec^{-1}$ using an E-type viscometer.

Working Examples A2 to A23

Developers were manufactured in the same manner as in Working Example A1 above, except that the types of materials used in the manufacture of the developers, and the amounts in which they were used, were varied to produce the compositions shown in Tables 1 and 2.

Comparative Example A1

A developer was manufactured in the same manner as in Working Example A 1 above, except that no substance A was used in the wet pulverization step, and the amounts in which the components were used were changed as shown in Table 2. Comparative Examples A2 to A7 Developers were manufactured in the same manner as in Working Example A1 above, except that the types of materials used in the manufacture of the developers, and the amounts in which they were used, were varied to produce the compositions shown in Table 2. The constitutions of the developers from the various working and comparative examples given above are compiled in Tables 1 and 2.

In the tables, PES denotes a polyester resin (acid value: 10 mg KOH/g, glass transition temperature: 55° C., softening point: 107° C.), StAc denotes a styrene acrylic resin (a styrene-n-butyl methacrylate copolymer, Himer SBM-73F made by Sanyo Chemical Industries), EP denotes an epoxy resin (Epikote 1007 made by Japan Epoxy Resin, Co. Ltd.; softening point: 128° C.), A1 denotes a polyoxyethylene monostyryl phenyl ether (a compound in which R in Formula 1 is a monostyrylated phenyl group and A is an ethylene group), A2 denotes a polyoxyethylene distyryl phenyl ether (a compound in which R in Formula 1 is a distyrylated phenyl group and A is an ethylene group), A3 denotes a polyoxyethylene tristyryl phenyl ether (a compound in which R in Formula 1 is a tristyrylated phenyl group and A is an ethylene group), A4 denotes a polyoxyethylene phenyl ether (a compound in which R in Formula 1 is a phenyl group and A is an ethylene group), A5 denotes a polyoxyethylene β-naphthyl ether (a compound in which R in Formula 1 is a β-naphthyl group and A is an ethylene group), A6 denotes a polyoxyethylene α-naphthyl ether (a compound in which R in Formula 1 is an α-naphthyl group and A is an ethylene group), A7 denotes a polyoxypropylene α-naphthyl ether (a compound in which R in Formula 1 is an α-naphthyl group and A is a propylene group), A8 denotes a mono-oxyethylene α-naphthyl ether (a compound in which R in Formula 1 is an α-naphthyl group, A is an ethylene group, and n is 1), A9 denotes a polyoxyethylene α-naphthyl ether (a compound in which R in Formula 1 is an α-naphthyl group, A is an ethylene group, and n is 10), A10 denotes a polyoxyethylene α-naphthyl ether (a compound in which R in Formula 1 is an α-naphthyl group, A is an ethylene group, and n is 25), MS denotes zirconium octylate as a fatty acid metal salt, CS denotes a dodecyl trimethyl ammonium salt as a cationic surfactant, S1 denotes butyl oleate, S2 denotes 2-ethylhexyl linoleate, S3 denotes tetradecyl caproate, S4 denotes soybean oil, S5 denotes a polyglyceride, S'1 denotes a hydrocarbon-based insulating liquid (Cosmo White made by Cosmo Oil Company), and S'2 denotes a dimethylsilicone (as a silicone-based insulating liquid; KF-96-20 made by Shin-Etsu Silicone).

TABLE 1

| | Composition of developer | | | | | | | | | | |
|---|---|---|---|---|---|---|---|---|---|---|---|
| | Toner particles | | | | Insulating | | | | Other | | |
| | Resin material | | | Colorant | liquid | | Substance A | | components | | Viscosity of |
| | Type | Content (wt %) | Tg (° C.) | Content (wt %) | Type | Content (wt %) | Type | Content (wt %) | Type | Content (wt %) | developer (mPa · s) |
| Ex. A1 | PES | 22.0 | 55 | 3.0 | S1 | 74.5 | A1 | 0.5 | — | — | 478 |
| Ex. A2 | PES | 22.0 | 55 | 3.0 | S2 | 74.5 | A1 | 0.5 | — | — | 465 |
| Ex. A3 | PES | 29.0 | 55 | 6.0 | S3 | 64.5 | A1 | 0.5 | — | — | 910 |
| Ex. A4 | PES | 22.0 | 55 | 3.0 | S4 | 74.5 | A1 | 0.5 | — | — | 855 |
| Ex. A5 | PES | 12.0 | 55 | 2.0 | S5 | 85.5 | A1 | 0.5 | — | — | 835 |
| Ex. A6 | PES | 22.0 | 55 | 3.0 | S1 | 74.5 | A2 | 0.5 | — | — | 481 |
| Ex. A7 | PES | 22.0 | 55 | 3.0 | S1 | 74.5 | A3 | 0.5 | — | — | 468 |
| Ex. A8 | PES | 22.0 | 55 | 3.0 | S1 | 74.5 | A4 | 0.5 | — | — | 499 |
| Ex. A9 | PES | 22.0 | 55 | 3.0 | S1 | 74.5 | A5 | 0.5 | — | — | 470 |
| Ex. A10 | StAc | 22.0 | 62 | 3.0 | S1 | 74.5 | A1 | 0.5 | — | — | 522 |
| Ex. A11 | EP | 22.0 | 48 | 3.0 | S1 | 74.5 | A1 | 0.5 | — | — | 554 |
| Ex. A12 | PES | 22.0 | 55 | 3.0 | S1 | 74.9 | A1 | 0.1 | — | — | 487 |
| Ex. A13 | PES | 22.0 | 55 | 3.0 | S1 | 72.0 | A1 | 3.0 | — | — | 420 |

TABLE 2

| | Composition of developer | | | | | | | | | | |
|---|---|---|---|---|---|---|---|---|---|---|---|
| | Toner particles | | | | Insulating | | | | Other | | Viscosity |
| | Resin material | | | Colorant | liquid | | Substance A | | components | | of |
| | Type | Content (wt %) | Tg (° C.) | Content (wt %) | Type | Content (wt %) | Type | Content (wt %) | Type | Content (wt %) | developer (mPa · s) |
| Ex. A14 | PES | 22.0 | 55 | 3.0 | S1 | 74.8 | A1 | 0.2 | — | — | 480 |
| Ex. A15 | PES | 22.0 | 55 | 3.0 | S1 | 73.0 | A1 | 2.0 | — | — | 443 |
| Ex. A16 | PES | 22.0 | 55 | 3.0 | S1 | 74.7 | A1 | 0.3 | — | — | 468 |
| Ex. A17 | PES | 22.0 | 55 | 3.0 | S1 | 73.5 | A1 | 1.5 | — | — | 448 |
| Ex. A18 | PES | 22.0 | 55 | 3.0 | S1 | 74.5 | A6 | 0.5 | — | — | 420 |
| Ex. A19 | PES | 22.0 | 55 | 3.0 | S1 | 74.5 | A7 | 0.5 | — | — | 440 |
| Ex. A20 | PES | 22.0 | 55 | 3.0 | S1 | 74.5 | A8 | 0.5 | — | — | 410 |
| Ex. A21 | PES | 22.0 | 55 | 3.0 | S1 | 74.5 | A9 | 0.5 | — | — | 442 |
| Ex. A22 | PES | 22.0 | 55 | 3.0 | S1 | 74.5 | A10 | 0.5 | — | — | 503 |
| Ex. A23 | PES | 22.0 | 55 | 3.0 | S1 | 74.5 | A1 + A2 | 0.25 + 0.25 | — | — | 475 |
| Comp. Ex. A1 | PES | 22.0 | 55 | 3.0 | S1 | 75.0 | — | — | — | — | 557 |
| Comp. Ex. A2 | PES | 22.0 | 55 | 3.0 | S1 | 74.96 | A1 | 0.04 | — | — | 542 |
| Comp. Ex. A3 | PES | 22.0 | 55 | 3.0 | S1 | 71.9 | A1 | 3.1 | — | — | 413 |
| Comp. Ex. A4 | PES | 22.0 | 55 | 3.0 | S'1 | 74.5 | A1 | 0.5 | — | — | 721 |
| Comp. Ex. A5 | PES | 22.0 | 55 | 3.0 | S'2 | 74.5 | A1 | 0.5 | — | — | 762 |

TABLE 2-continued

| | Composition of developer | | | | | | | | | | |
|---|---|---|---|---|---|---|---|---|---|---|---|
| | Toner particles | | | | Insulating liquid | | Substance A | | Other components | | Viscosity of developer (mPa · s) |
| | Resin material | | | Colorant | | | | | | | |
| | Type | Content (wt %) | Tg (° C.) | Content (wt %) | Type | Content (wt %) | Type | Content (wt %) | Type | Content (wt %) | |
| Comp. Ex. A6 | PES | 22.0 | 55 | 3.0 | S1 | 74.5 | — | — | MS | 0.5 | 570 |
| Comp. Ex. A7 | PES | 22.0 | 55 | 3.0 | S1 | 74.5 | — | — | CS | 0.5 | 581 |

A2 Evaluation

The developers obtained above were evaluated as follows.

A2-1 Electrophoretic Mobility

The developers of the working examples and comparative examples were evaluated as follows for electrophoretic mobility.

First, a developer was injected between electrodes at an electrode distance d=80 μm, and voltage was applied between the electrodes so that the potential difference V=40 V. The movement of the toner particles at this point was observed under an optical microscope, and an image of the movement situation was analyzed, which gave the movement distance of the particles per unit of time (=electrophoretic velocity v), and this was evaluated according to the following criteria. It can be said that the greater is the electrophoretic mobility, the more suited the developer is to high-speed developing.

A: Electrophoretic mobility is at least 35.0 $\mu m^2/Vs$.

B: Electrophoretic mobility is at least 20.0 $\mu m^2/Vs$, but less than 35.0.

C: Electrophoretic mobility is at least 12.5 $\mu m^2/Vs$, but less than 20.0.

D: Electrophoretic mobility is at least 10.0 $\mu m^2/Vs$, but less than 12.5.

E: Electrophoretic mobility is at least 7.5 $\mu m^2/Vs$, but less than 10.0.

F: Electrophoretic mobility is at least 5.0 $\mu m^2/Vs$, but less than 7.5.

G: Electrophoretic mobility is less than 5.0 $\mu m^2/Vs$.

A2-2 Charge Stability

The developer of each working example and of each comparative example was collected in a glass vessel and sealed, and then allowed to stand in a dark room for 30 days. At the end of the 30 days, the electrophoretic mobility was found by the method discussed in section A2-1 above, the percentage decrease in the electrophoretic mobility was found from this result, and this was evaluated according to the following criteria. This evaluation was not performed for samples whose initial electrophoretic mobility (the value found in section A2-1) was less than 5 $\mu m^2/Vs$. It can be said that the smaller is the percentage decrease in the electrophoretic mobility, the better is the charge stability.

A: Electrophoretic mobility is less than 3%.

B: Electrophoretic mobility is at least 3%, but less than 7%.

C: Electrophoretic mobility is at least 7%, but less than 10%.

D: Electrophoretic mobility is at least 10%, but less than 20%.

E: Electrophoretic mobility is at least 20%, but less than 30%.

F: Electrophoretic mobility is at least 30%.

A2-3 Dispersion Stability Test 10 mL of the developer obtained in each working example and each comparative example was placed in a test tube (diameter: 12 mm; length: 120 mm) and was allowed to stand for 10 days, after which the settling depth was measured and was evaluated according to the following four criteria.

A: The settling depth was 0 mm.

B: The settling depth was greater than 0 mm, but no more than 2 mm.

C: The settling depth was greater than 2 mm, but no more than 5 mm.

D: The settling depth was greater than 5 mm.

A2-4 Developing Efficiency

Using the image forming apparatus shown in FIGS. 1 and 2, a developer layer of each developer obtained in the working examples and comparative examples was formed on a developing roller of the image forming apparatus. The photoreceptor was then uniformly charged to a surface potential of 500 V and the developing roller to a surface potential of 300 V, and the photoreceptor was exposed to attenuate the charge on the photoreceptor surface to a surface potential of 50 V. After the developer layer had passed between the photoreceptor and the developing roller, toner particles on the developing roller and toner particles on the photoreceptor were collected with tape. The pieces of tape used for collection were stuck onto recording paper, and the density of the toner particles was measured. After measurement, the developing efficiency was found by dividing the density of the toner particles collected from the photoreceptor by the sum of the density of the toner particles collected from the photoreceptor and the density of the toner particles collected from the developing roller and then multiplying this quotient by 100. The developing efficiency was evaluated according to the following four criteria.

A: The developing efficiency was at least 95%, and was particularly excellent.

B: The developing efficiency was at least 90% and less than 95%, and was excellent.

C: The developing efficiency was at least 80% and less than 90%, and posed no practical problem.

D: The developing efficiency was less than 80%, and was inferior.

A2-5 Transfer Efficiency

Using the image forming apparatus shown in FIGS. 1 and 2, a developer layer of each developer obtained in the working examples and comparative examples was formed on a developing roller of the image forming apparatus. Then, after the developer layer had passed between the photoreceptor and the intermediate transfer component, toner particles on the photoreceptor and toner particles on the intermediate transfer component were collected with tape. The pieces of tape used for collection were stuck onto recording paper, and the density of the toner particles was measured. After measurement, the transfer efficiency was calculated by dividing the density of the toner particles collected from the intermediate transfer component by the sum of the density of the toner particles collected from the photoreceptor and the density of the toner particles collected from the intermediate transfer component and then multiplying this quotient by 100. The transfer efficiency was evaluated according to the following four criteria.

A: The transfer efficiency was at least 95%, and was particularly excellent.

B: The transfer efficiency was at least 90% and less than 95%, and was excellent.

C: The transfer efficiency was at least 80% and less than 90%, and posed no practical problem.

D: The transfer efficiency was less than 80%, and was inferior.

A2-6 Fixing Strength

An image in a specific pattern produced with the developer in each of the above working examples and comparative examples was formed on recording paper (LPCPPA4 woodfree paper made by Seiko Epson) using the image forming apparatus shown in FIGS. 1 and 2. After this, the image was heat fixed at a set fixing temperature of 160° C. The non-offset region was then confirmed, after which the fixed image on the recording paper was rubbed twice with an eraser (a Lion 261-11 abrasive eraser made by Lion Office Products) at a pressing load of 1.2 kgf, the percentage remainder of the image density was measured with an X-Rite model 404 device made by X-Rite, and the result was evaluated according to the following five criteria.

A: The remaining image density was at least 96% (extremely good).

B: The remaining image density was at least 90% and less than 96% (good).

C: The remaining image density was at least 80% and less than 90% (average).

D: The remaining image density was at least 70% and less than 80% (not very good).

E: The remaining image density was less than 70% (extremely poor).

A2-7 Fog Density

The reflection density of the non-image part of the recorded material obtained by heat fixing the toner image in section A2-6 above was measured with a reflection densitometer (X-Rite), and the result was evaluated according to the following criteria.

A: less than 0.08

B: at least 0.08 and less than 0.09

C: at least 0.09 and less than 0.11

D: at least 0.11 and less than 0.20

E: at least 0.20

These results are given in Table 3.

TABLE 3

| | Electro-phoretic mobility | Charge stability | Dispersion stability | Developing efficiency | Transfer efficiency | Fixing strength | Fog density |
|---|---|---|---|---|---|---|---|
| Ex. A1 | A | A | A | A | A | A | A |
| Ex. A2 | B | A | A | A | A | A | A |
| Ex. A3 | C | A | A | C | B | A | A |
| Ex. A4 | B | A | A | B | B | A | A |
| Ex. A5 | A | B | B | A | A | A | A |
| Ex. A6 | A | A | B | A | A | A | A |
| Ex. A7 | B | B | B | A | A | A | A |
| Ex. A8 | A | A | A | B | A | A | A |
| Ex. A9 | A | A | A | B | A | A | A |
| Ex. A10 | C | B | B | B | B | B | A |
| Ex. A11 | C | B | B | B | B | B | A |
| Ex. A12 | C | C | A | B | B | A | B |
| Ex. A13 | C | B | B | B | B | A | B |
| Ex. A14 | B | A | A | C | A | A | A |
| Ex. A15 | B | A | A | A | C | A | A |
| Ex. A16 | A | A | A | A | A | A | A |
| Ex. A17 | A | A | A | A | A | A | A |
| Ex. A18 | A | A | A | A | A | A | B |
| Ex. A19 | A | A | A | A | A | A | B |
| Ex. A20 | B | B | A | C | B | A | B |
| Ex. A21 | A | A | A | B | A | B | A |
| Ex. A22 | B | A | C | A | A | C | A |
| Ex. A23 | A | A | A | A | A | A | A |
| C. E. A1 | E | D | A | D | D | A | D |
| C. E. A2 | E | D | A | C | C | A | E |
| C. E. A3 | G | — | C | C | C | B | E |
| C. E. A4 | G | — | D | D | D | B | E |
| C. E. A5 | G | — | D | D | D | B | E |
| C. E. A6 | E | F | C | C | D | B | D |
| C. E. A7 | F | F | C | D | D | C | E |

Ex.: working example,
C. E.: comparative example

As is clear from Table 3, the developers of the invention had excellent electrophoretic mobility and were compatible with high-speed developing. The developers of the invention also had excellent positive charging characteristics and charge stability. Furthermore, the developers of the invention were excellent in terms of the dispersion stability of the toner particles in the developer, developing efficiency, transfer efficiency, and so forth. In contrast, satisfactory results were not obtained with the developers in the comparative examples.

Also, developers were manufactured in the same manner as above, but by changing the cyan pigment to a magenta pigment, a yellow pigment, and a black pigment, and these developers were evaluated in the same manner as above, which yielded results similar to those obtained above.

B1 Manufacture of Developer

Developers were produced as follows. All the steps were carried out at room temperature (25° C.) unless otherwise specified.

WORKING EXAMPLE

B1 Wet Pulverization Step

First, a mixture (weight ratio of 85:15) of a polyester resin (acid value: 10 mg KOH/g; glass transition temperature (Tg): 55° C.; softening point: 107° C.) (as a resin material) and a cyan pigment (Pigment Blue 15:3 made by Dainichiseika Colour & Chemicals) (as a colorant) was prepared. These components were mixed in a 20 L Henschel mixer to prepare a raw material for toner manufacture. Next, this raw material (mixture) was kneaded using a twin-screw kneader extruder. The kneaded material extruded from the extrusion port of the twin-screw kneader extruder was cooled. The kneaded material thus cooled was coarsely crushed into a coarse toner particle raw material having an average particle size of no more than 1.0 mm. A hammer mill was used for the coarse crushing of the kneaded material.

50 g of the coarsely crushed particles obtained by the above method, 1.0 g of mono-2-ethylhexyl phosphate (JAMP-8 made by Johoku Chemical) (as substance B), and 150 g of butyl oleate (as an insulating liquid; viscosity: 18.5 mPa·s, dielectric constant: 2.78) were put in a ceramic pot (600 mL internal volume). Zirconia beads (ball diameter of 1 mm) were then added to the ceramic pot so that the volumetric filler ratio would be 40%, and wet pulverization was performed for 48 hours at 230 rpm in a tabletop pot mill.

Bead Removal Step

After this, the zirconia beads were removed by suction filtration to obtain a developer. The viscosity at 25° C. of the developer thus obtained was 630 mPa·s. The volumetric average particle size ($D_{50}$) of the toner particles was 2.34 μm. The viscosity at 25° C. of the developer was found at a shear rate of 5.0 sec using an E-type viscometer.

Working Examples B2 to B18

Developers were manufactured in the same manner as in Working Example 131 above, except that the types of materials used in the manufacture of the developers, and the amounts in which they were used, were varied to produce the compositions shown in Tables 4 and 5.

Comparative Example A1

A developer was manufactured in the same manner as in Working Example A1 above, except that no substance B was used in the wet pulverization step, and the amounts in which the components were used were changed as shown in Table 5.

Comparative Examples B2 to B7

Developers were manufactured in the same manner as in Working Example B1 above, except that the types of materials used in the manufacture of the developers, and the amounts in which they were used, were varied to produce the compositions shown in Table 5. The constitutions of the developers from the various working and comparative examples given above are compiled in Tables 4 and 5.

In the tables, PES denotes a polyester resin (acid value: 10 mg KOH/g, glass transition temperature: 55° C., softening point: 107° C.), StAc denotes a styrene acrylic resin (a styrene-n-butyl methacrylate copolymer, Himer SBM-73F made by Sanyo Chemical Industries), EP denotes an epoxy resin (Epikote 1007 made by Japan Epoxy Resin, Co. Ltd.; softening point: 128° C.), B1 denotes mono-2-ethylhexyl phosphate (a compound in which R in Formula 1 is a 2-ethylhexyl group and n is 1), B2 denotes di-2-ethylhexyl phosphate (a compound in which R in Formula 1 is a 2-ethylhexyl group and n is 2), B3 denotes mono(2-hydroxyethyl methacrylate) phosphate (a compound in which R in Formula 1 is $CH_2{=}C(CH_3)COOC_2H_4$—, and n is 1), B4 denotes di(2-hydroxyethyl methacrylate) phosphate (a compound in which R in Formula 1 is $CH_2{=}C(CH_3)\,COOC_2H_4$—, and n is 2), B5 denotes mono-n-butyl phosphate (a compound in which R in Formula 1 is an n-butyl group and n is 1), B6 denotes mono-n-octyl phosphate (a compound in which R in Formula 1 is an n-octyl group and n is 1), MS denotes zirconium octylate as a fatty acid metal salt, CS denotes a dodecyl trimethyl ammonium salt as a cationic surfactant, S1 denotes butyl oleate, S2 denotes 2-ethylhexyl linoleate, S3 denotes tetradecyl caproate, S4 denotes soybean oil, S5 denotes a polyglyceride, S'1 denotes a hydrocarbon-based insulating liquid (Cosmo White made by Cosmo Oil Company), and S'2 denotes a dimethylsilicone (as a silicone-based insulating liquid; KF-96-20 made by Shin-Etsu Silicone).

TABLE 4

| | Composition of developer | | | | | | | | | | |
|---|---|---|---|---|---|---|---|---|---|---|---|
| | Toner particles | | | | Insulating | | | | Other | | Viscosity |
| | Resin material | | | Colorant | liquid | | Substance A | | components | | of |
| | Type | Content (wt %) | Tg (° C.) | Content (wt %) | Type | Content (wt %) | Type | Content (wt %) | Type | Content (wt %) | developer (mPa · s) |
| Ex. B1 | PES | 22.0 | 55 | 3.0 | S1 | 74.5 | B1 | 0.5 | — | — | 630 |
| Ex. B2 | PES | 22.0 | 55 | 3.0 | S2 | 74.5 | B1 | 0.5 | — | — | 640 |
| Ex. B3 | PES | 29.0 | 55 | 6.0 | S3 | 64.5 | B1 | 0.5 | — | — | 780 |
| Ex. B4 | PES | 22.0 | 55 | 3.0 | S4 | 74.5 | B1 | 0.5 | — | — | 990 |
| Ex. B5 | PES | 12.0 | 55 | 2.0 | S5 | 85.5 | B1 | 0.5 | — | — | 988 |
| Ex. B6 | PES | 22.0 | 55 | 3.0 | S1 | 74.5 | B2 | 0.5 | — | — | 635 |

TABLE 4-continued

| | Composition of developer | | | | | | | | | | |
|---|---|---|---|---|---|---|---|---|---|---|---|
| | Toner particles | | | | Insulating | | | | Other | | Viscosity |
| | Resin material | | | Colorant | liquid | | Substance A | | components | | of |
| | Type | Content (wt %) | Tg (° C.) | Content (wt %) | Type | Content (wt %) | Type | Content (wt %) | Type | Content (wt %) | developer (mPa · s) |
| Ex. B7 | PES | 22.0 | 55 | 3.0 | S1 | 74.5 | B1 + B2 | 0.25 + 0.25 | — | — | 647 |
| Ex. B8 | PES | 22.0 | 55 | 3.0 | S1 | 74.5 | B3 + B4 | 0.25 + 0.25 | — | — | 678 |
| Ex. B9 | PES | 22.0 | 55 | 3.0 | S1 | 74.5 | B5 | 0.5 | — | — | 630 |
| Ex. B10 | StAc | 22.0 | 62 | 3.0 | S1 | 74.5 | B1 | 0.5 | — | — | 714 |
| Ex. B11 | EP | 22.0 | 48 | 3.0 | S1 | 74.5 | B1 | 0.5 | — | — | 766 |
| Ex. B12 | PES | 22.0 | 55 | 3.0 | S1 | 74.9 | B1 | 0.1 | — | — | 574 |
| Ex. B13 | PES | 22.0 | 55 | 3.0 | S1 | 72.0 | B1 | 3.0 | — | — | 680 |

TABLE 5

| | Composition of developer | | | | | | | | | | |
|---|---|---|---|---|---|---|---|---|---|---|---|
| | Toner particles | | | | Insulating | | | | Other | | Viscosity |
| | Resin material | | | Colorant | liquid | | Substance A | | components | | of |
| | Type | Content (wt %) | Tg (° C.) | Content (wt %) | Type | Content (wt %) | Type | Content (wt %) | Type | Content (wt %) | developer (mPa · s) |
| Ex. B14 | PES | 22.0 | 55 | 3.0 | S1 | 74.8 | B1 | 0.2 | — | — | 592 |
| Ex. B15 | PES | 22.0 | 55 | 3.0 | S1 | 73.0 | B1 | 2.0 | — | — | 660 |
| Ex. B16 | PES | 22.0 | 55 | 3.0 | S1 | 74.7 | B1 | 0.3 | — | — | 611 |
| Ex. B17 | PES | 22.0 | 55 | 3.0 | S1 | 73.5 | B1 | 1.5 | — | — | 643 |
| Ex. B18 | PES | 22.0 | 55 | 3.0 | S1 | 74.5 | B6 | 0.5 | — | — | 662 |
| Comp. Ex. B1 | PES | 22.0 | 55 | 3.0 | S1 | 75.0 | — | — | — | — | 557 |
| Comp. Ex. B2 | PES | 22.0 | 55 | 3.0 | S1 | 74.96 | B1 | 0.04 | — | — | 567 |
| Comp. Ex. B3 | PES | 22.0 | 55 | 3.0 | S1 | 71.9 | B1 | 3.1 | — | — | 692 |
| Comp. Ex. B4 | PES | 22.0 | 55 | 3.0 | S'1 | 74.5 | B1 | 0.5 | — | — | 870 |
| Comp. Ex. B5 | PES | 22.0 | 55 | 3.0 | S'2 | 74.5 | B1 | 0.5 | — | — | 895 |
| Comp. Ex. B6 | PES | 22.0 | 55 | 3.0 | S1 | 74.5 | — | — | MS | 0.5 | 570 |
| Comp. Ex. B7 | PES | 22.0 | 55 | 3.0 | S1 | 74.5 | — | — | CS | 0.5 | 581 |

B2 Evaluation

The developers obtained above were evaluated as follows.

B2-1 Electrophoretic Mobility

The developers of the working examples and comparative examples were evaluated as follows for electrophoretic mobility.

First, a developer was injected between electrodes at an electrode distance d=80 μm, and voltage was applied between the electrodes so that the potential difference V=40 V. The movement of the toner particles at this point was observed under an optical microscope, and an image of the movement situation was analyzed, which gave the movement distance of the particles per unit of time (=electrophoretic velocity v), and this was evaluated according to the following criteria. It can be said that the greater is the electrophoretic mobility, the more suited the developer is to high-speed developing.

A: Electrophoretic mobility is at least 35.0 $\mu m^2/Vs$.

B: Electrophoretic mobility is at least 20.0 $\mu m^2/Vs$, but less than 35.0.

C: Electrophoretic mobility is at least 12.5 $\mu m^2/Vs$, but less than 20.0.

D: Electrophoretic mobility is at least 10.0 $\mu m^2/Vs$, but less than 12.5.

E: Electrophoretic mobility is at least 7.5 $\mu m^2/Vs$, but less than 10.0.

F: Electrophoretic mobility is at least 5.0 $\mu m^2/Vs$, but less than 7.5.

G: Electrophoretic mobility is less than 5.0 $\mu m^2/Vs$.

B2-2 Charge Stability

The developer of each working example and of each comparative example was collected in a glass vessel and sealed, and then allowed to stand in a dark room for 30 days. At the end of the 30 days, the electrophoretic mobility was found by the method discussed in section B2-1 above, the percentage decrease in the electrophoretic mobility was found from this result, and this was evaluated according to the following criteria. This evaluation was not performed for samples whose initial electrophoretic mobility (the value found in section B2-1) was less than 5 $\mu m^2/Vs$. It can be said that the smaller is the percentage decrease in the electrophoretic mobility, the better is the charge stability.

A: Electrophoretic mobility is less than 3%.

B: Electrophoretic mobility is at least 3%, but less than 7%.

C: Electrophoretic mobility is at least 7%, but less than 10%.

D: Electrophoretic mobility is at least 10%, but less than 20%.

E: Electrophoretic mobility is at least 20%, but less than 30%.

F: Electrophoretic mobility is at least 30%.

B2-3 Dispersion Stability Test 10 mL of the developer obtained in each working example and each comparative example was placed in a test tube (diameter: 12 mm; length: 120 mm) and was allowed to stand for 10 days, after which the settling depth was measured and was evaluated according to the following four criteria.

A: The settling depth was 0 mm.

B: The settling depth was greater than 0 mm, but no more than 2 mm.

C: The settling depth was greater than 2 mm, but no more than 5 mm.

D: The settling depth was greater than 5 mm.

B2-4 Developing Efficiency

Using the image forming apparatus shown in FIGS. 1 and 2, a developer layer of each developer obtained in the working examples and comparative examples was formed on a developing roller of the image forming apparatus. The photoreceptor was then uniformly charged to a surface potential of 500 V and the developing roller to a surface potential of 300 V, and the photoreceptor was exposed to attenuate the charge on the photoreceptor surface to a surface potential of 50 V. After the developer layer had passed between the photoreceptor and the developing roller, toner particles on the developing roller and toner particles on the photoreceptor were collected with tape. The pieces of tape used for collection were stuck onto recording paper, and the density of the toner particles was measured. After measurement, the developing efficiency was found by dividing the density of the toner particles collected from the photoreceptor by the sum of the density of the toner particles collected from the photoreceptor and the density of the toner particles collected from the developing roller and then multiplying this quotient by 100. The developing efficiency was evaluated according to the following four criteria.

A: The developing efficiency was at least 95%, and was particularly excellent.

B: The developing efficiency was at least 90% and less than 95%, and was excellent.

C: The developing efficiency was at least 80% and less than 90%, and posed no practical problem.

D: The developing efficiency was less than 80%, and was inferior.

B2-5 Transfer Efficiency

Using the image forming apparatus shown in FIGS. 1 and 2, a developer layer of each developer obtained in the working examples and comparative examples was formed on a developing roller of the image forming apparatus. Then, after the developer layer had passed between the photoreceptor and the intermediate transfer component, toner particles on the photoreceptor and toner particles on the intermediate transfer component were collected with tape. The pieces of tape used for collection were stuck onto recording paper, and the density of the toner particles was measured. After measurement, the transfer efficiency was calculated by dividing the density of the toner particles collected from the intermediate transfer component by the sum of the density of the toner particles collected from the photoreceptor and the density of the toner particles collected from the intermediate transfer component and then multiplying this quotient by 100. The transfer efficiency was evaluated according to the following four criteria.

A: The transfer efficiency was at least 95%, and was particularly excellent.

B: The transfer efficiency was at least 90% and less than 95%, and was excellent.

C: The transfer efficiency was at least 80% and less than 90%, and posed no practical problem.

D: The transfer efficiency was less than 80%, and was inferior.

B2-6 Fixing Strength

An image in a specific pattern produced with the developer in each of the above working examples and comparative examples was formed on recording paper (LPCPPA4 woodfree paper made by Seiko Epson) using the image forming apparatus shown in FIGS. 1 and 2. After this, the image was heat fixed at a set fixing temperature of 160° C. The non-offset region was then confirmed, after which the fixed image on the recording paper was rubbed twice with an eraser (a Lion 261-11 abrasive eraser made by Lion Office Products) at a pressing load of 1.2 kgf, the percentage remainder of the image density was measured with an X-Rite model 404 device made by X-Rite, and the result was evaluated according to the following five criteria.

A: The remaining image density was at least 96% (extremely good).

B: The remaining image density was at least 90% and less than 96% (good).

C: The remaining image density was at least 80% and less than 90% (average).

D: The remaining image density was at least 70% and less than 80% (not very good).

E: The remaining image density was less than 70% (extremely poor).

B2-7 Fog Density

The reflection density of the non-image part of the recorded material obtained by heat fixing the toner image in section B2-6 above was measured with a reflection densitometer (X-Rite), and the result was evaluated according to the following criteria.

A: less than 0.08

B: at least 0.08 and less than 0.09

C: at least 0.09 and less than 0.11

D: at least 0.11 and less than 0.20

E: at least 0.20

These results are given in Table 6.

TABLE 6

| | Electro-phoretic mobility | Charge stability | Dispersion stability | Developing efficiency | Transfer efficiency | Fixing strength | Fog density |
|---|---|---|---|---|---|---|---|
| Ex. B1 | A | A | A | A | A | A | A |
| Ex. B2 | A | A | A | B | A | A | A |
| Ex. B3 | B | B | B | B | B | A | A |
| Ex. B4 | C | A | A | C | B | B | A |
| Ex. B5 | C | B | A | C | B | B | A |
| Ex. B6 | B | B | A | B | A | A | B |
| Ex. B7 | B | A | A | A | A | A | A |
| Ex. B8 | B | A | A | A | A | A | A |
| Ex. B9 | B | B | A | A | A | A | A |
| Ex. B10 | C | B | B | B | A | B | B |
| Ex. B11 | C | B | B | B | A | B | B |
| Ex. B12 | C | C | A | C | B | A | B |
| Ex. B13 | C | B | A | B | C | A | B |
| Ex. B14 | B | A | A | C | A | A | A |
| Ex. B15 | B | A | A | A | C | A | A |
| Ex. B16 | A | A | A | A | A | A | B |
| Ex. B17 | A | A | A | A | A | A | B |
| Ex. B18 | A | A | A | A | A | A | B |
| C. E. B1 | E | D | A | D | D | A | D |
| C. E. B2 | E | D | A | C | D | B | E |
| C. E. B3 | G | — | A | D | D | C | E |
| C. E. B4 | G | — | D | D | D | C | E |
| C. E. B5 | G | — | D | D | D | D | E |
| C. E. B6 | E | F | C | C | D | B | D |
| C. E. B7 | F | F | C | D | D | C | E |

As is clear from Table 6, the developers of the invention had excellent electrophoretic mobility and were compatible with high-speed developing. The developers of the invention also had excellent positive charging characteristics and charge stability. Furthermore, the developers of the invention were excellent in terms of the dispersion stability of the toner particles in the developer, developing efficiency, transfer efficiency, and so forth. In contrast, satisfactory results were not obtained with the developers in the comparative examples. Also, developers were manufactured in the same manner as above, but by changing the cyan pigment to a magenta pigment, a yellow pigment, and a black pigment, and these developers were evaluated in the same manner as above, which yielded results similar to those obtained above.

C1 Manufacture of Developer

Developers were produced as follows. All the steps were carried out at room temperature (25° C.) unless otherwise specified.

Working Example C1

Wet Pulverization Step

First, a mixture (weight ratio of 85:15) of a polyester resin (acid value: 10 mg KOH/g; glass transition temperature (Tg): 55° C.; softening point: 107° C.) (as a resin material) and a cyan pigment (Pigment Blue 15:3 made by Dainichiseika Colour & Chemicals) (as a colorant) was prepared. These components were mixed in a 20 L Henschel mixer to prepare a raw material for toner manufacture. Next, this raw material (mixture) was kneaded using a twin-screw kneader extruder. The kneaded material extruded from the extrusion port of the twin-screw kneader extruder was cooled. The kneaded material thus cooled was coarsely crushed into a coarse toner particle raw material having an average particle size of no more than 1.0 mm. A hammer mill was used for the coarse crushing of the kneaded material.

50 g of the coarsely crushed particles obtained by the above method, 0.5 g of polyoxyethylene monostyryl phenyl ether (Pionin D-6512 made by Takemoto Oil & Fat) (as substance A), 0.5 g of mono-2-ethylhexyl phosphate (DAMP-8 made by Johoku Chemical) (as substance B), and 150 g of butyl oleate (as an insulating liquid; viscosity: 18.5 mPa·s, dielectric constant: 2.78) were put in a ceramic pot (600 mL internal volume). Zirconia beads (ball diameter of 1 mm) were then added to the ceramic pot so that the volumetric filler ratio would be 40%, and wet pulverization was performed for 48 hours at 230 rpm in a tabletop pot mill.

Bead Removal Step

After this, the zirconia beads were removed by suction filtration to obtain a developer. The viscosity at 25° C. of the developer thus obtained was 476 mPa·s. The volumetric average particle size ($D_{50}$) of the toner particles was 2.36 μm. The viscosity at 25° C. of the developer was found at a shear rate of 5.0 sec using an E-type viscometer.

Working Examples C2 to C27

Developers were manufactured in the same manner as in Working Example C1 above, except that the types of materials used in the manufacture of the developers, and the amounts in which they were used, were varied to produce the compositions shown in Tables 7 and 8.

Comparative Example C1

A developer was manufactured in the same manner as in Working Example C1 above, except that neither substance A nor substance B was used in the wet pulverization step, and the amounts in which the components were used were changed as shown in Table 8.

Comparative Examples C2 to C7

Developers were manufactured in the same manner as in Working Example C1 above, except that the types of materials used in the manufacture of the developers, and the amounts in which they were used, were varied to produce the compositions shown in Table 8.

The constitutions of the developers from the various working and comparative examples given above are compiled in Tables 7 and 8.

In the tables, PES denotes a polyester resin (acid value: 10 mg KOH/g, glass transition temperature: 55° C., softening point: 107° C.), StAc denotes a styrene acrylic resin (a styrene-n-butyl methacrylate copolymer, Himer SBM-73F made by Sanyo Chemical Industries), EP denotes an epoxy resin (Epikote 1007 made by Japan Epoxy Resin, Co. Ltd.; softening point: 128° C.), A1 denotes a polyoxyethylene monostyryl phenyl ether (a compound in which R in Formula 1 is a monostyrylated phenyl group and A is an ethylene group), A2 denotes a polyoxyethylene distyryl phenyl ether (a compound in which R in Formula 1 is a distyrylated phenyl group and A is an ethylene group), A3 denotes a polyoxyethylene tristyryl phenyl ether (a compound in which R in Formula 1 is a tristyrylated phenyl group and A is an ethylene group), A4 denotes a polyoxyethylene phenyl ether (a compound in which R in Formula 1 is a phenyl group and A is an ethylene group), A5 denotes a polyoxyethylene β-naphthyl ether (a compound in which R in Formula 1 is a β-naphthyl group and A is an ethylene group), A6 denotes a polyoxyethylene α-naphthyl ether (a compound in which R in Formula 1 is an α-naphthyl group and A is an ethylene group), A7 denotes a polyoxypropylene α-naphthyl ether (a compound in which R in Formula 1 is an α-naphthyl group and A is a propylene group), B1 denotes mono-2-ethylhexyl phosphate (a compound in which R in Formula 1 is a 2-ethylhexyl group and n is 1), B2 denotes di-2-ethylhexyl phosphate (a compound in which R in Formula 1 is a 2-ethylhexyl group and n is 2), B3 denotes mono(2-hydroxyethyl methacrylate) phosphate (a compound in which R in Formula 1 is $CH_2{=}C(CH_3)COOC_2H_4$—, and n is 1), B4 denotes di(2-hydroxyethyl methacrylate) phosphate (a compound in which R in Formula 1 is $CH_2{=}C(CH_3)COOC_2H_4$—, and n is 2), B5 denotes mono-n-butyl phosphate (a compound in which R in Formula 1 is an n-butyl group and n is 1), B6 denotes mono-n-octyl phosphate (a compound in which R in Formula 1 is an n-octyl group and n is 1), MS denotes zirconium octylate as a fatty acid metal salt, CS denotes a dodecyl trimethyl ammonium salt as a cationic surfactant, S1 denotes butyl oleate, S2 denotes 2-ethylhexyl linoleate, S3 denotes tetradecyl caproate, S4 denotes soybean oil, S5 denotes a polyglyceride, S'1 denotes a hydrocarbon-based insulating liquid (Cosmo White made by Cosmo Oil Company), and S'2 denotes a dimethylsilicone (as a silicone-based insulating liquid; KF-96-20 made by Shin-Etsu Silicone).

TABLE 7

| | Composition of developer | | | | | | | | | |
|---|---|---|---|---|---|---|---|---|---|---|
| | Toner particles | | | | Insulating liquid | | Substance A | | | |
| | Resin material | | | Colorant | | | | Content | Substance B | |
| | Type | Content (wt %) | Tg (° C.) | Content (wt %) | Type | Content (wt %) | Type | $X_A$ (wt %) | Type | Content $X_B$ (wt %) |
| Ex. C1 | PES | 22.0 | 55 | 3.0 | S1 | 74.5 | A1 | 0.25 | B1 | 0.25 |
| Ex. C2 | PES | 22.0 | 55 | 3.0 | S1 | 74.5 | A1 | 0.17 | B1 | 0.33 |
| Ex. C3 | PES | 22.0 | 55 | 3.0 | S1 | 74.5 | A1 | 0.33 | B1 | 0.17 |
| Ex. C4 | PES | 22.0 | 55 | 3.0 | S2 | 74.5 | A1 | 0.25 | B1 | 0.25 |
| Ex. C5 | PES | 29.0 | 55 | 6.0 | S3 | 64.5 | A1 | 0.25 | B1 | 0.25 |
| Ex. C6 | PES | 22.0 | 55 | 3.0 | S4 | 74.5 | A1 | 0.25 | B1 | 0.25 |
| Ex. C7 | PES | 12.0 | 55 | 2.0 | S5 | 85.5 | A1 | 0.25 | B1 | 0.25 |
| Ex. C8 | PES | 22.0 | 55 | 3.0 | S1 | 74.5 | A2 | 0.25 | B2 | 0.25 |
| Ex. C9 | PES | 22.0 | 55 | 3.0 | S1 | 74.5 | A3 | 0.25 | B1 + B2 | 0.125 + 0.125 |
| Ex. C10 | PES | 22.0 | 55 | 3.0 | S1 | 74.5 | A4 | 0.25 | B3 + B4 | 0.125 + 0.125 |
| Ex. C11 | PES | 22.0 | 55 | 3.0 | S1 | 74.5 | A5 | 0.25 | B5 | 0.25 |
| Ex. C12 | StAc | 22.0 | 62 | 3.0 | S1 | 74.5 | A1 | 0.25 | B1 | 0.25 |
| Ex. C13 | EP | 22.0 | 48 | 3.0 | S1 | 74.5 | A1 | 0.25 | B1 | 0.25 |
| Ex. C14 | PES | 22.0 | 55 | 3.0 | S1 | 74.9 | A1 | 0.05 | B1 | 0.05 |
| Ex. C15 | PES | 22.0 | 55 | 3.0 | S1 | 72.0 | A1 | 1.5 | B1 | 1.5 |
| Ex. C16 | PES | 22.0 | 55 | 3.0 | S1 | 74.8 | A1 | 0.1 | B1 | 0.1 |
| Ex. C17 | PES | 22.0 | 55 | 3.0 | S1 | 73.0 | A1 | 1.0 | B1 | 1.0 |

| | Composition of developer Other comp'ts | | | | Viscosity of |
|---|---|---|---|---|---|
| | Type | Content (wt %) | $X_A + X_B$ (wt %) | $X_A/(X_A + X_B)$ | developer (mPa · s) |
| Ex. C1 | — | — | 0.5 | 0.50 | 476 |
| Ex. C2 | — | — | 0.5 | 0.34 | 491 |
| Ex. C3 | — | — | 0.5 | 0.66 | 462 |
| Ex. C4 | — | — | 0.5 | 0.50 | 775 |
| Ex. C5 | — | — | 0.5 | 0.50 | 810 |
| Ex. C6 | — | — | 0.5 | 0.50 | 798 |
| Ex. C7 | — | — | 0.5 | 0.50 | 500 |
| Ex. C8 | — | — | 0.5 | 0.50 | 461 |
| Ex. C9 | — | — | 0.5 | 0.50 | 477 |
| Ex. C10 | — | — | 0.5 | 0.50 | 475 |
| Ex. C11 | — | — | 0.5 | 0.50 | 462 |
| Ex. C12 | — | — | 0.5 | 0.50 | 533 |
| Ex. C13 | — | — | 0.5 | 0.50 | 541 |
| Ex. C14 | — | — | 0.1 | 0.50 | 536 |

TABLE 7-continued

| | | | | | |
|---|---|---|---|---|---|
| Ex. C15 | — | — | 3.0 | 0.50 | 542 |
| Ex. C16 | — | — | 0.2 | 0.50 | 540 |
| Ex. C17 | — | — | 2.0 | 0.50 | 545 |

TABLE 8

| | Composition of developer | | | | | | | | | | | | | | |
|---|---|---|---|---|---|---|---|---|---|---|---|---|---|---|---|
| | Toner particles | | | | Insulating | | Substance A | | Substance B | | | | | | |
| | Resin material | | | Colorant | liquid | | | Content | | Content | Other comp'ts | | | | Viscosity of |
| | Type | Content (wt %) | Tg (° C.) | Content (wt %) | Type | Content (wt %) | Type | $X_A$ (wt %) | Type | $X_B$ (wt %) | Type | Content (wt %) | $X_A + X_B$ (wt %) | $X_A/(X_A + X_B)$ | developer (mPa · s) |
| Ex. C18 | PES | 22.0 | 55 | 3.0 | S1 | 74.7 | A1 | 0.2 | B1 | 0.1 | — | — | 0.3 | 0.67 | 490 |
| Ex. C19 | PES | 22.0 | 55 | 3.0 | S1 | 73.5 | A1 | 0.7 | B1 | 0.8 | — | — | 1.5 | 0.47 | 495 |
| Ex. C20 | PES | 22.0 | 55 | 3.0 | S1 | 74.5 | A1 | 0.15 | B1 | 0.35 | — | — | 0.5 | 0.30 | 491 |
| Ex. C21 | PES | 22.0 | 55 | 3.0 | S1 | 74.5 | A1 | 0.35 | B1 | 0.15 | — | — | 0.5 | 0.70 | 492 |
| Ex. C22 | PES | 22.0 | 55 | 3.0 | S1 | 74.5 | A1 | 0.1 | B1 | 0.4 | — | — | 0.5 | 0.20 | 484 |
| Ex. C23 | PES | 22.0 | 55 | 3.0 | S1 | 74.5 | A1 | 0.4 | B1 | 0.1 | — | — | 0.5 | 0.80 | 482 |
| Ex. C24 | PES | 22.0 | 55 | 3.0 | S1 | 74.5 | A6 | 0.25 | B6 | 0.25 | — | — | 0.5 | 0.50 | 477 |
| Ex. C25 | PES | 22.0 | 55 | 3.0 | S1 | 74.5 | A7 | 0.25 | B1 | 0.25 | — | — | 0.5 | 0.50 | 502 |
| Ex. C26 | PES | 22.0 | 55 | 3.0 | S1 | 74.5 | — | — | B1 | 0.5 | — | — | 0.5 | — | 630 |
| Ex. C27 | PES | 22.0 | 55 | 3.0 | S1 | 74.5 | A1 | 0.5 | — | — | — | — | 0.5 | — | 478 |
| C. E. 1 | PES | 22.0 | 55 | 3.0 | S1 | 75.0 | — | — | — | — | — | — | 0 | — | 557 |
| C. E. 2 | PES | 22.0 | 55 | 3.0 | S1 | 74.96 | A1 | 0.02 | B1 | 0.02 | — | — | 0.04 | 0.50 | 531 |
| C. E. 3 | PES | 22.0 | 55 | 3.0 | S1 | 71.9 | A1 | 1.55 | B1 | 1.55 | — | — | 3.1 | 0.50 | 669 |
| C. E. 4 | PES | 22.0 | 55 | 3.0 | S'1 | 74.5 | A1 | 0.25 | B1 | 0.25 | — | — | 0.5 | 0.50 | 754 |
| C. E. 5 | PES | 22.0 | 55 | 3.0 | S'2 | 74.5 | A1 | 0.25 | B1 | 0.25 | — | — | 0.5 | 0.50 | 779 |
| C. E. 6 | PES | 22.0 | 55 | 3.0 | S1 | 74.5 | — | — | — | — | MS | 0.5 | 0 | — | 570 |
| C. E. 7 | PES | 22.0 | 55 | 3.0 | S1 | 74.5 | — | — | — | — | CS | 0.5 | 0 | — | 581 |

C2 Evaluation

The developers obtained above were evaluated as follows.

C2-1 Electrophoretic Mobility

The developers of the working examples and comparative examples were evaluated as follows for electrophoretic mobility.

First, a developer was injected between electrodes at an electrode distance d=80 μm, and voltage was applied between the electrodes so that the potential difference V=20 V. The movement of the toner particles at this point was observed under an optical microscope, and an image of the movement situation was analyzed, which gave the movement distance of the particles per unit of time (=electrophoretic velocity v), and this was evaluated according to the following criteria. It can be said that the greater is the electrophoretic mobility, the more suited the developer is to high-speed developing.

A: Electrophoretic mobility is at least 35.0 $\mu m^2/Vs$.

B: Electrophoretic mobility is at least 20.0 $\mu m^2/Vs$, but less than 35.0.

C: Electrophoretic mobility is at least 12.5 $\mu m^2/Vs$, but less than 20.0.

D: Electrophoretic mobility is at least 10.0 $\mu m^2/Vs$, but less than 12.5.

E: Electrophoretic mobility is at least 7.5 $\mu m^2/Vs$, but less than 10.0.

F: Electrophoretic mobility is at least 5.0 $\mu m^2/Vs$, but less than 7.5.

G: Electrophoretic mobility is less than 5.0 $\mu m^2/Vs$.

C2-2 Charge Stability

The developer of each working example and of each comparative example was collected in a glass vessel and sealed, and then allowed to stand in a dark room for 30 days. At the end of the 30 days, the electrophoretic mobility was found by the method discussed in section C2-1 above, the percentage decrease in the electrophoretic mobility was found from this result, and this was evaluated according to the following criteria. This evaluation was not performed for samples whose initial electrophoretic mobility (the value found in section C2-1) was less than 5 $\mu m^2/Vs$. It can be said that the smaller is the percentage decrease in the electrophoretic mobility, the better is the charge stability.

A: Electrophoretic mobility is less than 3%.

B: Electrophoretic mobility is at least 3%, but less than 7%.

C: Electrophoretic mobility is at least 7%, but less than 10%.

D: Electrophoretic mobility is at least 10%, but less than 20%.

E: Electrophoretic mobility is at least 20%, but less than 30%.

F: Electrophoretic mobility is at least 30%.

C2-3 Dispersion Stability Test 10 mL of the developer obtained in each working example and each comparative example was placed in a test tube (diameter: 12 mm; length: 120 mm) and was allowed to stand for 10 days, after which the settling depth was measured and was evaluated according to the following four criteria.

A: The settling depth was 0 mm.

B: The settling depth was greater than 0 mm, but no more than 2 mm.

C: The settling depth was greater than 2 mm, but no more than 5 mm.

D: The settling depth was greater than 5 mm.

C2-4 Developing Efficiency

Using the image forming apparatus shown in FIGS. 1 and 2, a developer layer of each developer obtained in the working examples and comparative examples was formed on a developing roller of the image forming apparatus. The photoreceptor was then uniformly charged to a surface potential of 400 V and the developing roller to a surface potential of 300 V, and the photoreceptor was exposed to attenuate the charge on the photoreceptor surface to a surface potential of 50 V. After the developer layer had passed between the photoreceptor and the developing roller, toner particles on the developing roller and toner particles on the photoreceptor were collected with tape. The pieces of tape used for collection were stuck onto recording paper, and the density of the toner particles was measured. After measurement, the developing efficiency was found by dividing the density of the toner particles collected from the photoreceptor by the sum of the density of the toner particles collected from the photoreceptor and the density of the toner particles collected from the developing roller and then multiplying this quotient by 100. The developing efficiency was evaluated according to the following four criteria.

A: The developing efficiency was at least 98%, and was particularly excellent.

B: The developing efficiency was at least 93% and less than 98%, and was excellent.

C: The developing efficiency was at least 85% and less than 93%, and posed no practical problem.

D: The developing efficiency was less than 85%, and was inferior.

C2-5 Transfer Efficiency

Using the image forming apparatus shown in FIGS. 1 and 2, a developer layer of each developer obtained in the working examples and comparative examples was formed on a developing roller of the image forming apparatus. Then, after the developer layer had passed between the photoreceptor and the intermediate transfer component, toner particles on the photoreceptor and toner particles on the intermediate transfer component were collected with tape. The pieces of tape used for collection were stuck onto recording paper, and the density of the toner particles was measured. After measurement, the transfer efficiency was calculated by dividing the density of the toner particles collected from the intermediate transfer component by the sum of the density of the toner particles collected from the photoreceptor and the density of the toner particles collected from the intermediate transfer component and then multiplying this quotient by 100. The transfer efficiency was evaluated according to the following four criteria.

A: The transfer efficiency was at least 98%, and was particularly excellent.

B: The transfer efficiency was at least 93% and less than 98%, and was excellent.

C: The transfer efficiency was at least 85% and less than 93%, and posed no practical problem.

D: The transfer efficiency was less than 85%, and was inferior.

C2-6 Fixing Strength

An image in a specific pattern produced with the developer in each of the above working examples and comparative examples was formed on recording paper (LPCPPA4 woodfree paper made by Seiko Epson) using the image forming apparatus shown in FIGS. 1 and 2. After this, the image was heat fixed at a set fixing temperature of 160° C. The non-offset region was then confirmed, after which the fixed image on the recording paper was rubbed twice with an eraser (a Lion 261-11 abrasive eraser made by Lion Office Products) at a pressing load of 1.2 kgf, the percentage remainder of the image density was measured with an X-Rite model 404 device made by X-Rite, and the result was evaluated according to the following five criteria.

A: The remaining image density was at least 95% (extremely good).

B: The remaining image density was at least 90% and less than 95% (good).

C: The remaining image density was at least 80% and less than 90% (average).

D: The remaining image density was at least 70% and less than 80% (not very good).

E: The remaining image density was less than 70% (extremely poor).

C2-7 Fog Density

The reflection density of the non-image part of the recorded material obtained by heat fixing the toner image in section C2-6 above was measured with a reflection densitometer (X-Rite), and the result was evaluated according to the following criteria.

A: less than 0.08

B: at least 0.08 and less than 0.09

C: at least 0.09 and less than 0.11

D: at least 0.11 and less than 0.20

E: at least 0.20

These results are given in Table 9.

TABLE 9

| | Electrophoretic mobility | Charge stability | Dispersion stability | Developing efficiency | Transfer efficiency | Fixing strength | Fog density |
|---|---|---|---|---|---|---|---|
| Working Ex. C1 | A | A | A | A | A | A | A |
| Working Ex. C2 | A | A | A | A | A | A | A |
| Working Ex. C3 | A | A | A | A | A | A | A |
| Working Ex. C4 | B | A | A | B | A | A | A |
| Working Ex. C5 | C | A | A | C | B | B | A |
| Working Ex. C6 | C | A | A | C | B | B | A |
| Working Ex. C7 | A | B | A | B | A | B | A |
| Working Ex. C8 | A | A | A | A | B | A | A |
| Working Ex. C9 | B | B | A | B | B | A | A |
| Working Ex. C10 | A | A | B | A | A | A | A |
| Working Ex. C11 | A | A | B | A | A | A | A |
| Working Ex. C12 | C | B | B | B | B | B | A |
| Working Ex. C13 | C | B | B | B | B | B | A |
| Working Ex. C14 | C | C | A | C | B | A | B |
| Working Ex. C15 | C | B | A | A | C | A | B |
| Working Ex. C16 | B | B | A | B | A | A | A |
| Working Ex. C17 | B | B | A | A | B | A | A |
| Working Ex. C18 | A | A | A | A | A | A | A |
| Working Ex. C19 | A | A | A | A | A | A | A |
| Working Ex. C20 | A | B | A | A | A | A | A |

TABLE 9-continued

| | Electro-phoretic mobility | Charge stability | Dispersion stability | Developing efficiency | Transfer efficiency | Fixing strength | Fog density |
|---|---|---|---|---|---|---|---|
| Working Ex. C21 | A | B | A | A | A | A | A |
| Working Ex. C22 | B | B | A | A | A | A | B |
| Working Ex. C23 | A | B | B | A | A | A | B |
| Working Ex. C24 | B | A | A | B | A | A | B |
| Working Ex. C25 | B | A | A | B | A | A | B |
| Working Ex. C26 | D | D | A | C | B | A | C |
| Working Ex. C27 | D | D | A | B | C | A | C |
| Comp. Ex. C1 | E | D | A | D | D | A | D |
| Comp. Ex. C2 | E | D | A | C | C | A | E |
| Comp. Ex. C3 | G | — | B | D | D | B | E |
| Comp. Ex. C4 | G | — | D | D | D | C | E |
| Comp. Ex. C5 | G | — | D | D | D | D | E |
| Comp. Ex. C6 | E | F | C | C | D | B | D |
| Comp. Ex. C7 | F | F | C | D | D | C | E |

As is clear from Table 9, the developers of the invention had excellent electrophoretic mobility and were compatible with high-speed developing. The developers of the invention also had excellent positive charging characteristics and charge stability. Furthermore, the developers of the invention were excellent in terms of the dispersion stability of the toner particles in the developer, developing efficiency, transfer efficiency, and so forth. In contrast, satisfactory results were not obtained with the developers in the comparative examples.

What is claimed is:

1. A developer comprising:

toner particles; and an insulating liquid, wherein a fatty acid ester is contained as the insulating liquid, a substance A expressed by the following formula (1) and a substance B expressed by the following formula (2) are further contained, $$R—O—(—AO—)_nH \quad (1)$$

where R is a phenyl group, a styrylated phenyl group, an α-naphthyl group, or a β-naphthyl group, A is an alkylene group, and n is an integer of at least 1, $$(RO)_n—\overset{\overset{\displaystyle O}{\|}}{P}—(OH)_{3-n} \quad (2)$$

where R is an organic group having a carbon number of at least 1 and no more than 15, and n is an integer of at least 1 and no more than 3, and the total percentage in which substance A and substance B are contained is at least 0.1 wt % and no more than 3.0 wt %.

2. The developer according to claim 1, wherein substance A has a polyoxyethylene structure.

3. The developer according to claim 1, wherein substance B has a hydrocarbon group with a branched chain.

4. The developer according to claim 1, wherein substance B has a straight-chain alkyl group with a carbon number of at least 4 and no more than 12.

5. The developer according to claim 1, wherein substance B is expressed by the following formula (3):

$$(R^1COOR^2O)_n—\overset{\overset{\displaystyle O}{\|}}{P}—(OH)_{3-n} \quad (3)$$

(in Formula 3, $R^1$ is a hydrocarbon group with a carbon number of at least 1 and no more than 7, and $R^2$ is a hydrocarbon group with a carbon number of at least 1 and no more than 7).

6. The developer according to claim 1, wherein $R^1$ has an unsaturated bond.

7. The developer according to claim 1, wherein the relation $0.01 \leq X_A/(X_A+X_B) \leq 0.99$ is satisfied when $X_A$ is the content (wt %) of substance A and $X_B$ is the content (wt %) of substance B.

8. The developer according to claim 1, wherein the fatty acid ester is an ester of a monovalent fatty acid and a monovalent alcohol.

9. The developer according to claim 1, wherein the fatty acid ester is an ester of a fatty acid and a straight-chain alcohol.

10. The developer according to claim 1, wherein the fatty acid ester is an ester of a fatty acid and an alcohol with a carbon number of at least 4 and no more than 14.

11. The developer according to claim 1, wherein the toner particles are made up of a material containing a polyester resin.

12. A developer comprising:

toner particles; and an insulating liquid, wherein a fatty acid ester is contained as the insulating liquid, a substance B expressed by the following formula is further contained, $$(RO)_n—\overset{\overset{\displaystyle O}{\|}}{P}—(OH)_{3-n}$$

where R is an organic group having a carbon number of at least 1 and no more than 15, and n is an integer of at least 1 and no more than 3, and the total percentage in which substance B is contained is at least 0.1 wt % and no more than 3.0 wt %.

* * * * *